US010762866B2

(12) United States Patent
Morein

(10) Patent No.: US 10,762,866 B2
(45) Date of Patent: Sep. 1, 2020

(54) DISPLAY RESCAN

(71) Applicant: Synaptics Incorporated, San Jose, CA (US)

(72) Inventor: Stephen L. Morein, San Jose, CA (US)

(73) Assignee: Synaptics Incorporated, San Jose, CA (US)

( * ) Notice: Subject to any disclaimer, the term of this patent is extended or adjusted under 35 U.S.C. 154(b) by 91 days.

(21) Appl. No.: 16/118,377

(22) Filed: Aug. 30, 2018

(65) Prior Publication Data

US 2020/0074949 A1 Mar. 5, 2020

(51) Int. Cl.
*G09G 3/36* (2006.01)
*G09G 3/34* (2006.01)

(52) U.S. Cl.
CPC ..... *G09G 3/3677* (2013.01); *G09G 3/342* (2013.01); *G09G 3/3688* (2013.01); *G09G 2310/0237* (2013.01); *G09G 2310/04* (2013.01)

(58) Field of Classification Search
CPC .... G09G 3/3677; G09G 3/342; G09G 3/3688; G09G 2310/0237; G09G 2310/04
See application file for complete search history.

(56) References Cited

U.S. PATENT DOCUMENTS 8,259,139 B2 9/2012 Culbert et al.
10,475,370 B2 * 11/2019 Spitzer ..... G09G 3/2085
2003/0006949 A1 1/2003 Sekiya et al.
2006/0238486 A1 * 10/2006 Hiraki ..... G09G 3/342 345/102
2008/0231624 A1 9/2008 Poon
2009/0046104 A1 * 2/2009 Boiko ..... G09G 3/3648 345/545
2014/0184475 A1 * 7/2014 Tantos ..... H04N 21/234345 345/8
2016/0232869 A1 8/2016 Ann et al.
(Continued)

FOREIGN PATENT DOCUMENTS

CN 105913825 A 8/2016
KR 10-2016-0034503 A 3/2016
KR 10-2018-0036429 A 4/2018

OTHER PUBLICATIONS

International Search Report and Written Opinion issued in Intl. Appl. No. PCT/US2019/027561 dated Aug. 2, 2019, 10 pages.
(Continued)

*Primary Examiner* — Bryan Earles
(74) *Attorney, Agent, or Firm* — Paradice & Li LLP

(57) ABSTRACT

A method and apparatus for updating pixel elements of a display device. The display device comprises a pixel array including a plurality of pixel elements and one or more light sources to illuminate the pixel array at a first instance of time. A data driver is configured to receive a frame of display data corresponding to an image to be displayed on the pixel array at a first instance of time. The data driver scans each row of the pixel array, during a pixel adjustment period prior to the first instance of time, to drive a plurality of first voltages onto the plurality of pixel elements, respectively, based on the received frame. The data driver further rescans a subset of rows of the pixel array, during the pixel adjustment period, to drive second voltages onto respective pixel elements in the subset of rows based on the received frame.

18 Claims, 21 Drawing Sheets

(56) References Cited

U.S. PATENT DOCUMENTS

| | | | | |
|---|---|---|---|---|
| 2016/0267715 | A1* | 9/2016 | Patel | G09G 5/395 |
| 2017/0018219 | A1 | 1/2017 | Wang et al. | |
| 2017/0236466 | A1 | 8/2017 | Spitzer et al. | |
| 2018/0095274 | A1* | 4/2018 | Lee | G09G 3/001 |
| 2018/0136720 | A1* | 5/2018 | Spitzer | G06F 3/013 |

OTHER PUBLICATIONS

International Search Report and Written Opinion dated Nov. 20, 2019, issued in International Application No. PCT/US2019/044931, 10 pages.

* cited by examiner

DISPLAY RESCAN

TECHNICAL FIELD

The present embodiments relate generally to display devices, and specifically to techniques for rescanning a display device.

BACKGROUND OF RELATED ART

Head-mounted display (HMD) devices are configured to be worn on, or otherwise affixed to, a user's head. An HMD device may comprise one or more displays positioned in front of one, or both, of the user's eyes. The HMD may display images (e.g., still images, sequences of images, and/or videos) from an image source overlaid with information and/or images from the user's surrounding environment (e.g., as captured by a camera), for example, to immerse the user in a virtual world. HMD devices have applications in medical, military, gaming, aviation, engineering, and various other professional and/or entertainment industries.

Many HMD devices use liquid-crystal display (LCD) technologies in their displays. An LCD display panel may be formed from an array of pixel elements (e.g., liquid crystal cells) arranged in rows and columns. Each row of pixel elements is coupled to a respective gate line, and each column of pixel elements is coupled to a respective data (or source) line. A pixel element may be accessed (e.g., updated with new pixel data) by driving a relatively high voltage on a gate line to "select" or activate a corresponding row of pixel elements, and driving another voltage on a corresponding data line to apply the update to the selected pixel element. The voltage level of the data line may depend on the desired color and/or intensity of the target pixel value. Thus, LCD display panels may be updated by successively "scanning" the rows of pixel elements (e.g., one row at a time), until each row of the pixel array has been updated.

The voltage applied on the data line changes the color and/or brightness of the pixel element by changing the physical state of (e.g., rotating) the particular pixel element. Thus, each pixel element may require time to settle into the new state or position. The settling time of a particular pixel element may depend on the degree of change in color and/or brightness. For example, transitioning from a maximum brightness setting (e.g., a "white" pixel) to a minimum brightness setting (e.g., a "black" pixel) may require greater settling time than transitioning from an intermediate brightness setting to another intermediate brightness setting (e.g., from one shade of "gray" to a different shade of "gray"). The delay in pixel transition may cause ghosting and/or other visual artifacts to appear on the display when the settling time of the pixel elements is slower than the time between successive frame updates.

LCD overdrive is a technique for accelerating pixel transitions when updating an LCD display. Specifically, a pixel element is driven to a higher voltage than the target voltage associated with the desired color and/or brightness level. The higher voltage causes the liquid crystal to rotate faster, and thus reach the target brightness in less time. On fixed LCD displays (e.g., televisions, monitors, mobile phones, etc.), an object is often illuminated by the same pixel elements for the duration of multiple frames. Thus, the amount of overdrive applied to the pixel elements of a fixed LCD display can be approximate since the user may be unable to detect errors in the corresponding pixel color and/or brightness when such errors last only a single frame.

However, on HMD devices, and particularly in virtual reality (VR) applications, an object viewed on the display may be illuminated by different pixels as the user's head and/or eyes move. Therefore, the amount of overdrive applied to each pixel element of an HMD display should be much more precise to preserve the user's sense of immersion in the virtual environment.

SUMMARY

This Summary is provided to introduce in a simplified form a selection of concepts that are further described below in the Detailed Description. This Summary is not intended to identify key features or essential features of the claims subject matter, nor is it intended to limit the scope of the claimed subject matter.

A method and apparatus for updating pixel elements of a display device. The display device comprises a pixel array including a plurality of pixel elements. A data driver is configured to receive a frame of display data corresponding to an image to be displayed on the pixel array at a first instance of time. The data driver scans each row of the pixel array, during a pixel adjustment period prior to the first instance of time, to drive a plurality of first voltages onto the plurality of pixel elements, respectively, based on the received frame. The data driver further rescans a subset of rows of the pixel array, during the pixel adjustment period, to drive second voltages onto respective pixel elements in the subset of rows based on the received frame. One or more light sources are configured to illuminate the pixel array at the first instance of time. In some embodiments, the one or more light sources may be deactivated during the pixel adjustment period.

In some embodiments, the display device may include overdrive circuitry configured to determine a plurality of pixel values for the plurality of pixel elements, respectively, based on the received frame. For each pixel element in the array, the overdrive circuitry may determine a target voltage that causes the pixel element to settle at its target pixel value. The overdrive circuitry may further select at least some of the pixel elements to receive overdrive voltages, where the overdrive voltage for a pixel element is different than the target voltage for that pixel element. In some aspects, the overdrive circuitry may select the subset of rows to be rescanned based at least in part on the pixel elements selected to receive overdrive voltages.

In some embodiments, the data driver may scan each row of the pixel array by driving the overdrive voltages onto respective pixel elements in the subset of rows of the pixel array and driving the target voltages onto respective pixel elements in each of the remaining rows of the pixel array. The data driver may further rescan each row of the pixel array by driving the target voltages onto respective pixel elements in the subset of rows of the pixel array.

In some embodiments, the image may include a full field-of-view (FFOV) image and a foveal image positioned within the FFOV image. The display device may further include a display driver configured to select a plurality of pixel elements of the pixel array to display each pixel of the FFOV image. The display driver may further select a respective pixel element of the pixel array to display each pixel of the foveal image. In some aspects, the display driver may select the subset of rows based at least in part on the pixel elements selected to display the foveal image. In some embodiments, each of the first voltages may be used to render the FFOV image on respective pixel elements of the pixel array and at least some of the second voltages may be used to render the foveal image on respective pixel elements of the pixel array.

In some embodiments, the data driver may scan each row of the pixel array by activating groups of pixel elements in succession, where each group of pixel elements includes a plurality of rows of the pixel array, and driving the first voltages onto respective pixel elements in the plurality of rows, concurrently, for each activated group. The data driver may further rescan each row of the pixel array by activating each row of pixel elements in the subset of rows in succession and driving the second voltages onto respective pixel elements in each activated row. In some aspects, the scanning may be performed at a faster rate than the rescanning.

BRIEF DESCRIPTION OF THE DRAWINGS

The present embodiments are illustrated by way of example and are not intended to be limited by the figures of the accompanying drawings.

DETAILED DESCRIPTION

Figure 1:
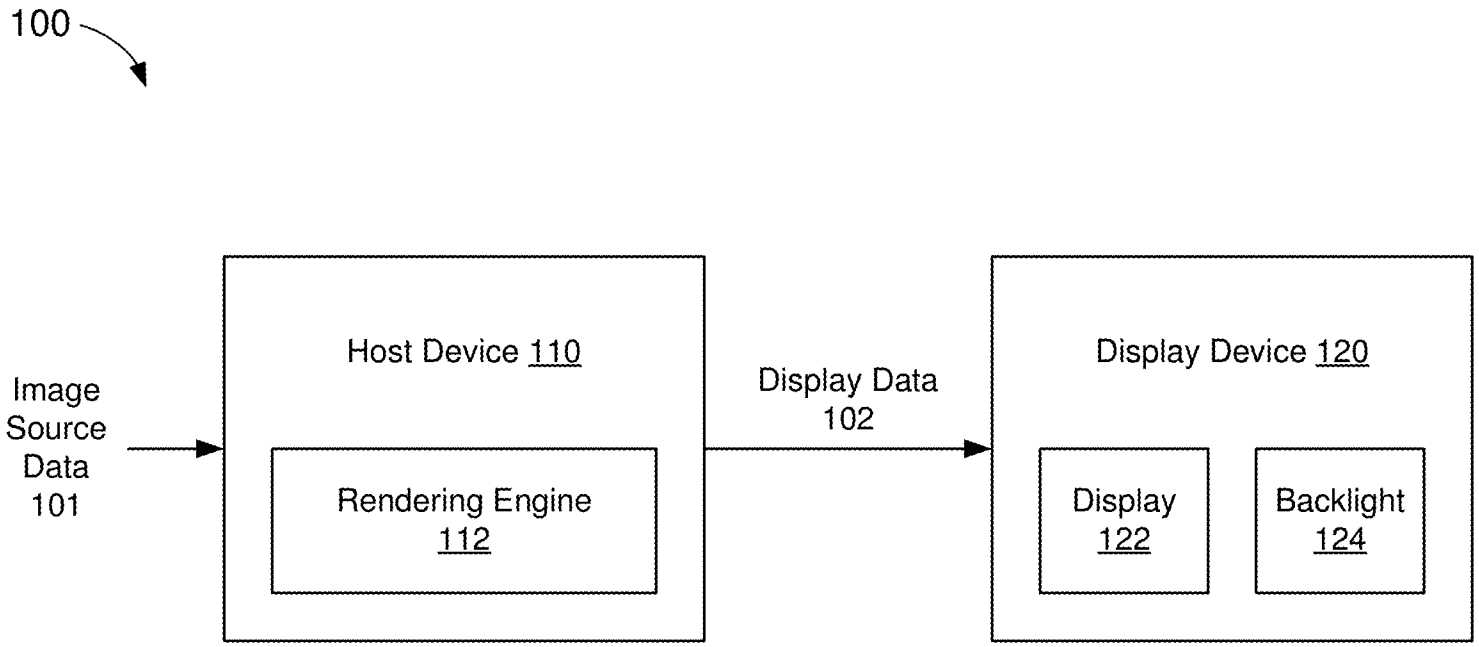
FIG. 1 shows an example display system within which the present embodiments may be implemented.

In the following description, numerous specific details are set forth such as examples of specific components, circuits, and processes to provide a thorough understanding of the present disclosure. The term "coupled" as used herein means connected directly to or connected through one or more intervening components or circuits. The terms "electronic system" and "electronic device" may be used interchangeably to refer to any system capable of electronically processing information. Also, in the following description and for purposes of explanation, specific nomenclature is set forth to provide a thorough understanding of the aspects of the disclosure. However, it will be apparent to one skilled in the art that these specific details may not be required to practice the example embodiments. In other instances, well-known circuits and devices are shown in block diagram form to avoid obscuring the present disclosure. Some portions of the detailed descriptions which follow are presented in terms of procedures, logic blocks, processing and other symbolic representations of operations on data bits within a computer memory.

These descriptions and representations are the means used by those skilled in the data processing arts to most effectively convey the substance of their work to others skilled in the art. In the present disclosure, a procedure, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system. It should be borne in mind, however, that all of these and similar terms are to be associated with the appropriate physical quantities and are merely convenient labels applied to these quantities.

Unless specifically stated otherwise as apparent from the following discussions, it is appreciated that throughout the present application, discussions utilizing the terms such as "accessing," "receiving," "sending," "using," "selecting," "determining," "normalizing," "multiplying," "averaging," "monitoring," "comparing," "applying," "updating," "measuring," "deriving" or the like, refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

In the figures, a single block may be described as performing a function or functions; however, in actual practice, the function or functions performed by that block may be performed in a single component or across multiple components, and/or may be performed using hardware, using software, or using a combination of hardware and software. To clearly illustrate this interchangeability of hardware and software, various illustrative components, blocks, modules, circuits, and steps have been described below generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. Also, the example input devices may include components other than those shown, including well-known components such as a processor, memory and the like.

The techniques described herein may be implemented in hardware, software, firmware, or any combination thereof, unless specifically described as being implemented in a specific manner. Any features described as modules or components may also be implemented together in an integrated logic device or separately as discrete but interoperable logic devices. If implemented in software, the techniques may be realized at least in part by a non-transitory processor-readable storage medium comprising instructions that, when executed, performs one or more of the methods described above. The non-transitory processor-readable data storage medium may form part of a computer program product, which may include packaging materials.

The non-transitory processor-readable storage medium may comprise random access memory (RAM) such as synchronous dynamic random access memory (SDRAM), read only memory (ROM), non-volatile random access memory (NVRAM), electrically erasable programmable read-only memory (EEPROM), FLASH memory, other known storage media, and the like. The techniques additionally, or alternatively, may be realized at least in part by a processor-readable communication medium that carries or communicates code in the form of instructions or data structures and that can be accessed, read, and/or executed by a computer or other processor.

The various illustrative logical blocks, modules, circuits and instructions described in connection with the embodiments disclosed herein may be executed by one or more processors. The term "processor," as used herein may refer to any general purpose processor, conventional processor, controller, microcontroller, and/or state machine capable of executing scripts or instructions of one or more software programs stored in memory. The term "voltage source," as used herein may refer to a direct-current (DC) voltage source, an alternating-current (AC) voltage source, or any other means of creating an electrical potential (such as ground).

FIG. 1 shows an example display system 100 within which the present embodiments may be implemented. The display system 100 includes a host device 110 and a display device 120. The display device 120 may be any device configured to display an image, or sequence of images (e.g., video), to a user. In some embodiments, the display device 120 may be a head-mounted display (HMD) device. In some aspects, the host device 110 may be implemented as a physical part of the display device 120. Alternatively, the host device 110 may be coupled to (and communicate with) components of the display device 120 using various wired and/or wireless interconnection and communication technologies, such as buses and networks. Example technologies may include Inter-Integrated Circuit ($I^2C$), Serial Peripheral Interface (SPI), PS/2, Universal Serial bus (USB), Bluetooth®, Infrared Data Association (IrDA), and various radio frequency (RF) communication protocols defined by the IEEE 802.11 standard.

The host device 110 receives image source data 101 from an image source (not shown for simplicity) and renders the image source data 101 for display (e.g., as display data 102) on the display device 120. In some embodiments, the host device 110 may include a rendering engine 112 configured to process the image source data 101 according to one or more capabilities of the display device 120. For example, in some aspects, the display device 120 may display a dynamically-updated image to a user based on the user's eye position. More specifically, the display device 120 may track the user's head and/or eye movements and may display a portion of the image coinciding with a fixation point of the user (e.g., foveal region) with higher resolution than other regions of the image (e.g., the full-frame image). Thus, in some embodiments, the rendering engine 112 may generate a high-resolution foveal image to be overlaid in the foveal region of the full-frame image. In some other embodiments, the rendering engine 112 may scale the full-frame image for display (e.g., at a lower-resolution than the foveal image) on the display device 120.

The display device 120 receives the display data 102 from the host device 110 and displays a corresponding image to the user based on the received display data 102. In some embodiments, the display device 120 may include a display 122 and a backlight 124. The display 122 may be a liquid-crystal display (LCD) panel formed from an array of pixel elements (e.g., liquid crystal cells) configured to allow varying amounts of light to pass from one surface of the display panel to another (e.g., depending on a voltage or electric field applied to each pixel element). For example, the display device 120 may apply an appropriate voltage to each of the pixel elements to render an image (which may include a foveal image overlaid upon a full-frame image) on the display 122. As described above, LCDs do not emit light and therefore rely on a separate light source to illuminate the pixel elements so that the image is viewable by the user.

The backlight 124 may be positioned adjacent the display 122 to illuminate the pixel elements from behind. The backlight 124 may comprise one or more light sources including, but not limited to, cold cathode fluorescent lamps (CCFLs), external electrode fluorescent lamps (EEFLs), hot-cathode fluorescent lamps (HCFLs), flat fluorescent lamps (FFLs), light-emitting diodes (LEDs), or any combination thereof. In some aspects, the backlight 124 may include an array of discrete light sources (such as LEDs) that can provide different levels of illumination to different regions of the display 122. In some embodiments, the display device 120 may include an inverter (not shown for simplicity) that can dynamically alter the intensity or brightness of the backlight 124, for example, to enhance image quality and/or conserve power.

In a fixed LCD display, the backlight 124 may provide continuous illumination to the pixel array (e.g., the backlight is constantly on or at least pulse-width modulated to a desired brightness level). Thus, any changes in pixel values may be noticeable as soon as the updated voltages are applied to the pixel elements. However, in virtual reality (VR) applications, an object viewed on the display may be illuminated by different pixels as the user's head and/or eyes move. Rapid changes in pixel values may cause motion blur and/or other artifacts in the images rendered on the LCD display, which may impair the virtual reality experience. The display device may reduce or prevent motion blur by periodically (rather than continuously) updating the display. For example, the display device may flash the backlight at periodic intervals so that rapid changes in pixel values in between such intervals are suppressed (e.g., similar to the saccadic suppression phenomenon in human visual perception).

Figure 2:
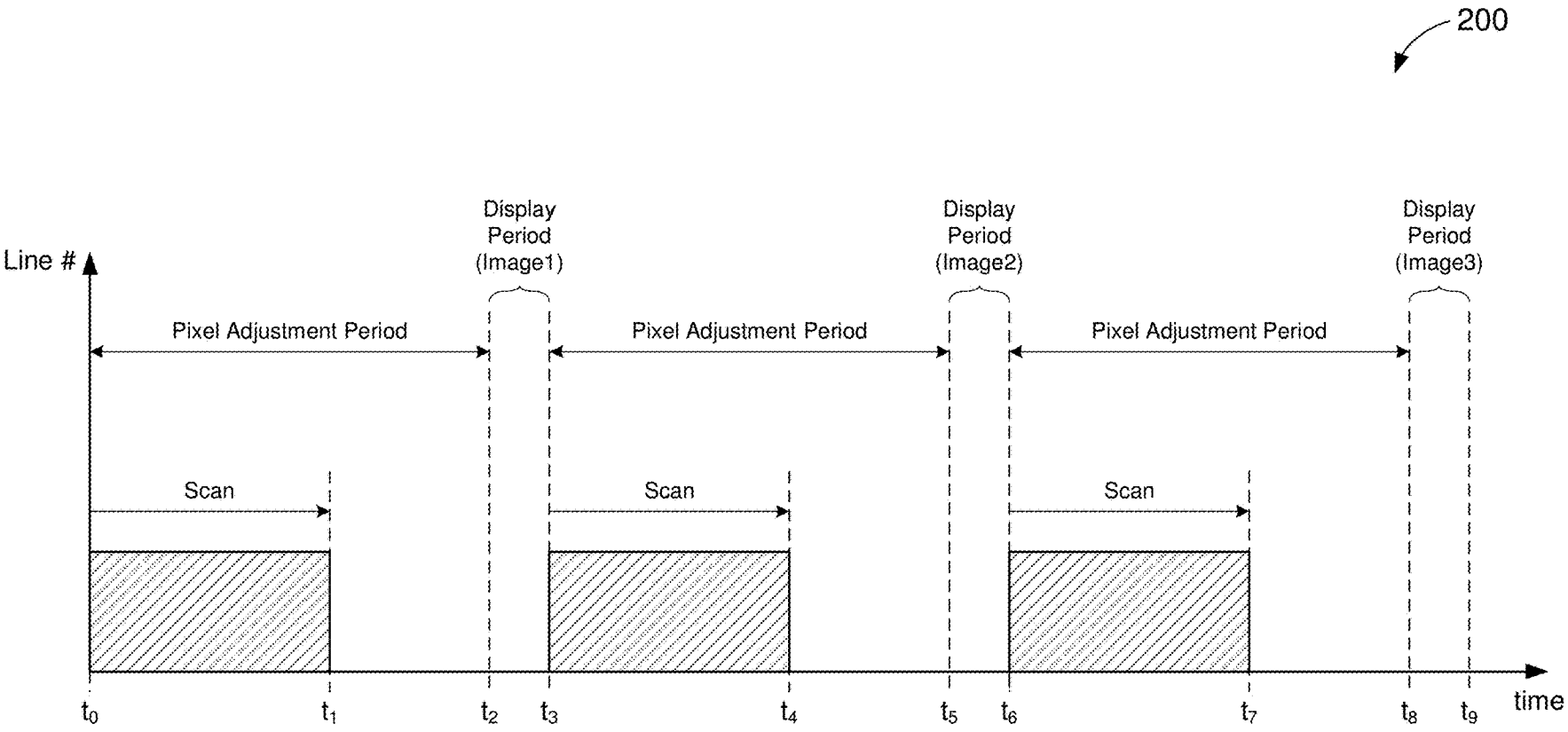
FIG. 2 shows a timing diagram depicting an example operation for periodically updating the pixel elements of a display device.

FIG. 2 shows a timing diagram 200 depicting an example operation for periodically updating the pixel elements of a display device. As shown in FIG. 2, each display update includes a pixel adjustment period (e.g., from times $t_0$ to $t_2$, $t_3$ to $t_5$, and $t_6$ to $t_8$) followed by a display period (e.g., from times $t_2$ to $t_3$, $t_5$ to $t_6$, and $t_8$ to $t_9$) to display a sequence of images (e.g., image 1, image 2, and image 3). During each pixel adjustment period, the display device may "scan" an array of pixel elements (e.g., one row at a time) to update the pixel values for each pixel element of the display. More specifically, each pixel element may be driven with a desired voltage that causes the pixel element to transition to a new pixel value (or remain at the current pixel value). During each display period, the backlight (or one or more light sources) of the display device is activated or turned on for a brief duration to illuminate the pixel array and display the image on the display device. It is noted that the backlight may remain deactivated or turned off during the pixel adjustment periods (e.g., so that the pixel updates are not noticeable to the user).

In conventional LCD displays, the pixel array is scanned only once during each pixel adjustment period. For example, a voltage may be driven onto each pixel element of the pixel array only once before the pixel array is illuminated for display. However, aspects of the present disclosure recognize that it may be desirable to make further adjustments to the pixel values after an initial scan has been completed. For example, the additional adjustments may be used to further refine or correct the pixel value for a particular pixel element. Thus, in some embodiments, a display device may rescan one or more rows of the pixel array (e.g., after an initial scan has been performed) to apply a second set of voltages to the pixel elements in the rescanned rows. More specifically, the display device may apply two or more voltages (e.g., at different times) to the same pixel element during a single pixel adjustment period.

Figure 3:
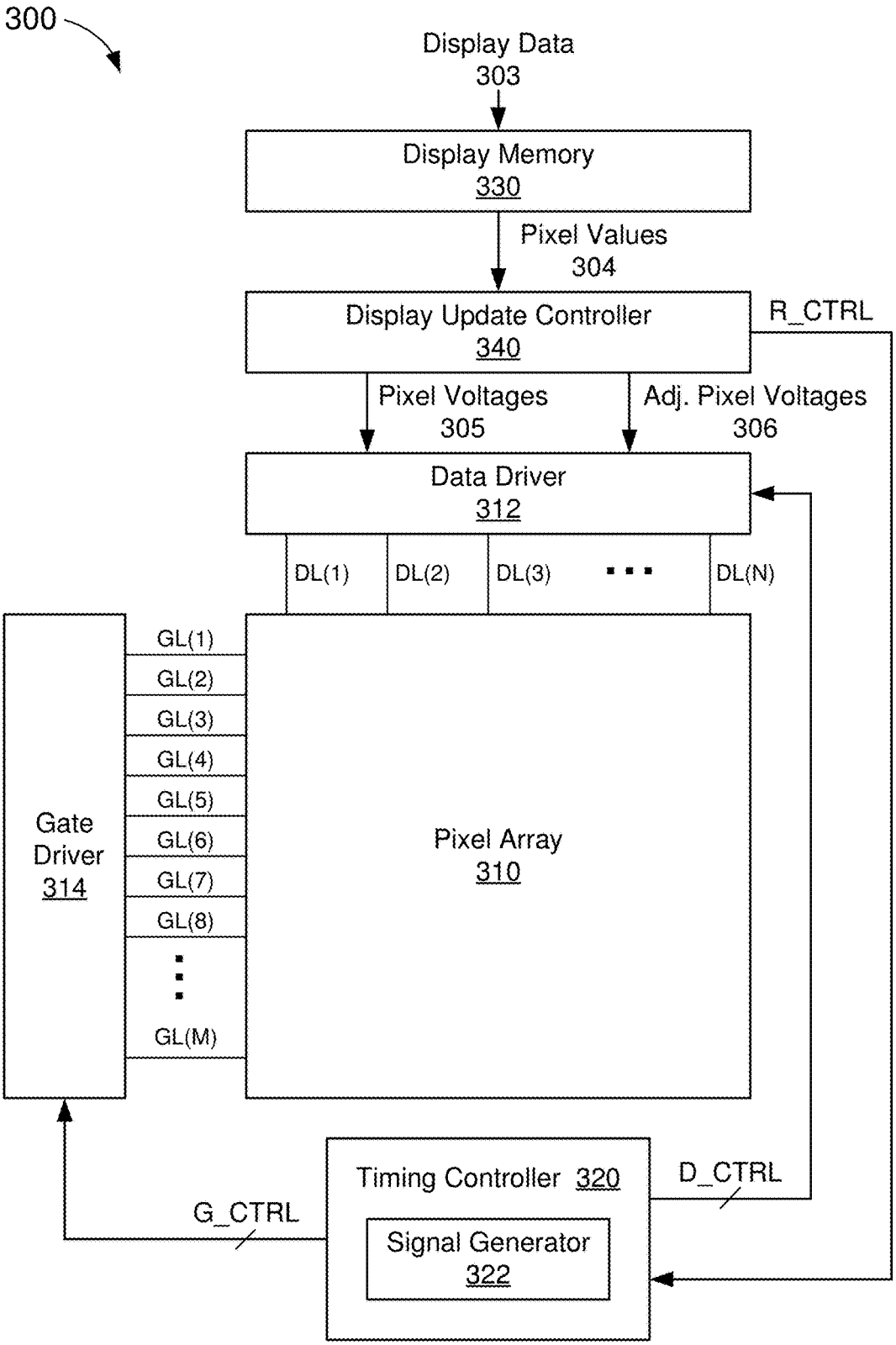
FIG. 3 shows a block diagram of a display device, in accordance with some embodiments.

FIG. 3 shows a block diagram of a display device 300, in accordance with some embodiments. The display device 300 may be an example embodiment of the display device 120 of FIG. 1. The display device 300 may include a pixel array 310, a timing controller 320, a display memory 330, and a display update controller 340. In some embodiments, the display device 300 may correspond to an LCD display panel. The pixel array 310 may comprise a plurality of pixel elements (not shown for simplicity). Each row of pixel elements is coupled to a respective gate line (GL), and each column of pixel elements is coupled to a respective data line (DL). Accordingly, each pixel element in the array 310 is positioned at an intersection of a gate line and a data line.

A data driver 312 is coupled to the pixel array 310 via the data lines DL(1)-DL(N). In some aspects, the data driver 312 may be configured to drive pixel data (e.g., in the form of a corresponding voltage) to individual pixel elements, via the data lines DL(1)-DL(N), to update a frame or image displayed by the pixel array 310. For example, the voltage driven onto the data lines DL(1)-DL(N) may alter the physical state (e.g., rotation) of the pixel elements in the array 310 (e.g., where the pixel elements are liquid crystals). Thus, the voltage applied to each pixel element may affect the color and/or intensity of light emitted by that pixel element. It is noted that each row of pixel elements in the pixel array 310 is coupled to the same data lines DL(1)-DL(N). Thus, the display device 300 may update the pixel array 310 by successively scanning the rows of pixel elements (e.g., one row at a time).

A gate driver 314 is coupled to the pixel array 310 via the gate lines GL(1)-GL(M). In some aspects, the gate driver 314 may be configured to select which row of pixel elements is to receive the pixel data driven by the data driver 312 at any given time. For example, each pixel element in the array 310 may be coupled to one of the data lines DL(1)-DL(N) and one of the gate lines GL(1)-GL(M) via an access transistor (not shown for simplicity). The access transistor may be an NMOS (or PMOS) transistor having a gate terminal coupled to one of the gate lines GL(1)-GL(M), a drain (or source) terminal coupled to one of the data lines DL(1)-DL(N), and a source (or drain) terminal coupled to a corresponding pixel element in the array 310. When one of the gate lines GL(1)-GL(M) is driven with a sufficiently high voltage, the access transistors coupled to the selected gate line turn on and allow current to flow from the data lines DL(1)-DL(N) to the corresponding pixel elements coupled to the selected gate line. Accordingly, the gate driver 314 may be configured to select or activate each of the gate lines GL(1)-GL(M), in succession, until each row of the pixel array 310 has been updated.

The timing controller 320 is configured to control a timing of the data driver 312 and the gate driver 314. For example, the timing controller 320 may generate a first set of timing control signals (D_CTRL) to control activation of the data lines DL(1)-DL(N) by the data driver 312. The timing controller 320 may also generate a second set of timing control signals (G_CTRL) to control activation of the gate lines GL(1)-GL(M) by the gate driver 314. The timing controller 320 may generate the D_CTRL and G_CTRL signals based on a reference clock signal generated by a signal generator 322. For example, the signal generator 322 may be a crystal oscillator. The timing controller 320 may drive the D_CTRL and G_CTRL signals based by applying respective phase offsets to the reference clock signal. More specifically, the timing of the D_CTRL signals and G_CTRL signals may be synchronized such that the gate driver 314 activates the correct gate line (e.g., coupled to the row of pixel elements to be driven with pixel data) at the time the data driver 312 drives the data lines DL(1)-DL(N) with the pixel data intended for that row of pixel elements.

The display memory 330 may be configured to store or buffer display data 303 corresponding to an image to be displayed on the pixel array 310. The display data 303 may include pixel values 304 (e.g., corresponding to a color and/or intensity) for one or more pixel element in the array 310. For example, each pixel element may comprise a plurality of subpixels including, but not limited to, red (R), green (G), and blue (B) subpixels. In some aspects, the display data 303 may indicate R, G, and B values for the subpixels of the image to be displayed. The R, G, and B values may affect the color and intensity (e.g., gray level) of each pixel element. For example, each pixel value 304 may be an 8-bit value representing one of 256 possible grayscale levels. Each pixel value 304 may be associated with a target voltage level. The target voltage may be a voltage which, when applied to a particular pixel element, causes the color and/or brightness of the pixel element to settle to the desired pixel value.

The display update controller 340 may determine pixel voltages to be applied to one or more pixel elements in the array 310 based, at least in part, on the pixel values 304. More specifically, for each pixel element of the array 310, the display update controller 340 may compare the current pixel value (e.g., the pixel value from a previous frame update) to a target pixel value (e.g., the pixel value for the next frame update) to determine the amount of voltage to be applied to the pixel element to effect the desired change in pixel value within a frame update period. In some embodiments, the display update controller 340 may facilitate multiple scans (e.g., a scan and a rescan) of the pixel array during a single frame update period. For example, during an initial scan of the pixel array, the display update controller 340 may determine a respective pixel voltage 305 to be applied (e.g., by the data driver 312) to each pixel element of the pixel array 310. During a subsequent rescan of the pixel array, the display update controller 340 may determine adjusted pixel voltages 306 to be applied to respective pixel elements in one or more rows of the pixel array 310.

In some embodiments, each row of the pixel array 310 may be updated during the rescanning operation. For example, the display update controller 340 may determine a pixel voltage 305 and an adjusted pixel voltage 306 for each pixel element of the pixel array 310. In some other embodiments, only a smaller subset of rows may be rescanned during the rescanning operation. For example, the display update controller 340 may determine adjusted pixel voltages 306 only for respective pixel elements in the subset of rows. In some aspects, the display update controller 340 may provide a rescan control signal (R_CTRL) to the timing controller 320 indicating the subset of rows to be rescanned. Thus, during the rescanning operation, the timing controller 320 may successively activate only the subset of rows indicated by the rescan control signal to be driven with adjusted pixel voltages 306.

Figure 4:
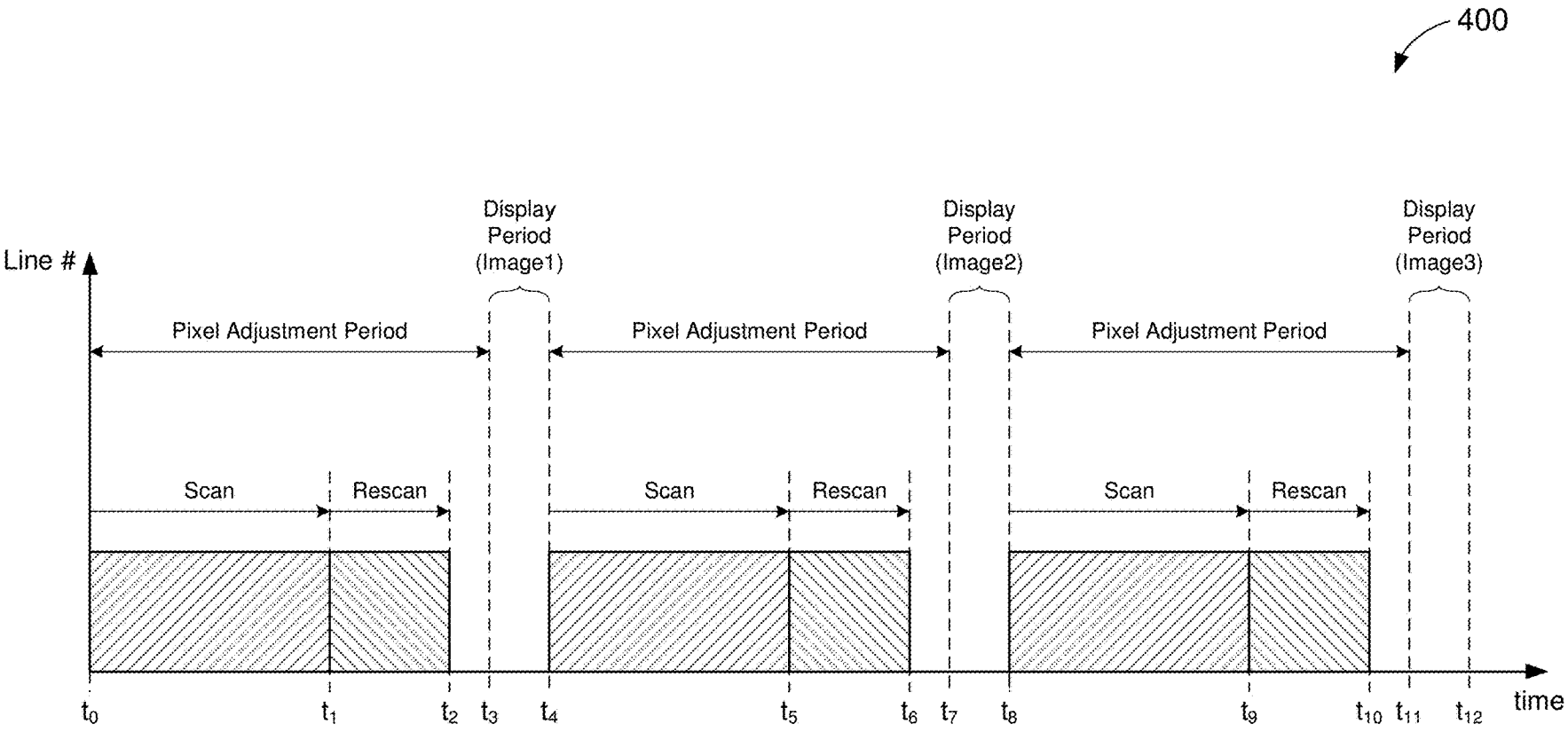
FIG. 4 shows a timing diagram depicting an example scan-rescan pixel update operation, in accordance with some embodiments.

FIG. 4 shows a timing diagram 400 depicting an example scan-rescan pixel update operation, in accordance with some embodiments. The example operation depicted in FIG. 4 may be performed by a display device such as the display device 300 of FIG. 3. Thus, in some embodiments, the display device may be configured to perform multiple scans of a pixel array during a single frame update interval (e.g., when updating the pixel array to display a new frame or image).

As shown in FIG. 4, each frame update interval comprises a pixel adjustment period (e.g., from times $t_0$ to $t_3$, $t_4$ to $t_7$, and $t_8$ to $t_{11}$) followed by a display period (e.g., from times $t_3$ to $t_4$, $t_7$ to $t_8$, and $t_{11}$ to $t_{12}$) to display a corresponding image (e.g., image 1, image 2, and image 3). During each pixel adjustment period, the display device may scan an array of pixel elements (e.g., from times $t_0$ to $t_1$, $t_4$ to $t_5$, and $t_8$ to $t_9$) to update the pixel values for each pixel element of the display. The display device may then rescan one or more rows of pixel elements (e.g., from times $t_1$ to $t_2$, $t_5$ to $t_6$, and $t_9$ to $t_{10}$), during the same pixel adjustment period, to further adjust the voltages and/or pixel values for a subset of pixel elements in the pixel array. Thus, aspects of the present disclosure may leverage the duration between display periods (specifically, between the end of a scan and the start of a display period) to refine or correct the pixel values for one or more pixel elements.

In some embodiments, the rescan operation may be used for overdrive correction. For example, in some aspects, a pixel element may be driven with an overdrive voltage that exceeds (e.g., above or below) the target voltage that would cause the pixel element to settle at the target pixel value. As described in greater detail below, the overdrive voltage may cause the pixel element to transition to the target pixel value at a faster rate. However, the overdrive voltage may also cause the pixel element to settle at a pixel value beyond (e.g., higher or lower than) the target pixel value. This may further complicate the pixel voltage calculations for the next image or frame to be displayed. Thus, in some embodiments, the display device may rescan the pixel elements for which overdrive voltages have been applied (e.g., from the initial scan) to cause the pixel elements to settle at their target pixel values. For example, the display device may apply target voltages to respective pixel elements in the rescanned rows.

In some other embodiments, the rescan operation may be used for foveal rendering. For example, in some aspects, the image to displayed may comprise a full field-of-view (FFOV) image combined with a foveal image. More specifically, the foveal image may be displayed within a foveal region of the FFOV image. Merging the pixel values of the FFOV image and the foveal image may consume time and resources, which may further limit the rate at which the pixel array can be updated. Thus, in some embodiments, the display the device may render the FFOV image and the foveal image on the pixel array separately and at different rates. For example, the display device may render the FFOV image at a faster rate than the foveal image. In some aspects, the display device may update each pixel element of the pixel array to render the FFOV image during the initial scan. The display device may subsequently rescan the rows of the pixel array corresponding to the foveal region of the FFOV image to render the foveal image therein.

Overdrive Correction

As described above, the color and/or brightness of each pixel element may be adjusted by changing the voltage applied to that pixel element. Specifically, the target voltage associated with a particular pixel value may represent the voltage which, when applied to a pixel element, causes the pixel element to settle at the desired pixel value. However, the degree of change in color and/or brightness that can be achieved in a single frame transition or update may be limited by the settling time of the pixel element. For example, transitioning from a maximum brightness value (e.g., a "white" pixel) to a minimum brightness value (e.g., a "black" pixel) may require greater settling time than transitioning from an intermediate brightness value to another intermediate brightness value (e.g., from one shade of "gray" to a different shade of "gray").

If the change in pixel value exceeds a threshold amount, the target voltage may be insufficient to drive the pixel element to the desired pixel value within a given frame update period. If the pixel element is unable to achieve the desired color and/or brightness between successive frame updates, artifacts (such as ghosting) may appear in the displayed image. LCD overdrive is a technique for increasing the speed of pixel transitions when updating an LCD display. Specifically, a pixel element is driven to a higher voltage than the target voltage associated with the desired color and/or brightness level. The higher voltage causes the liquid crystal in each pixel element to rotate faster, and thus transition to the target brightness in less time.

Figure 5:
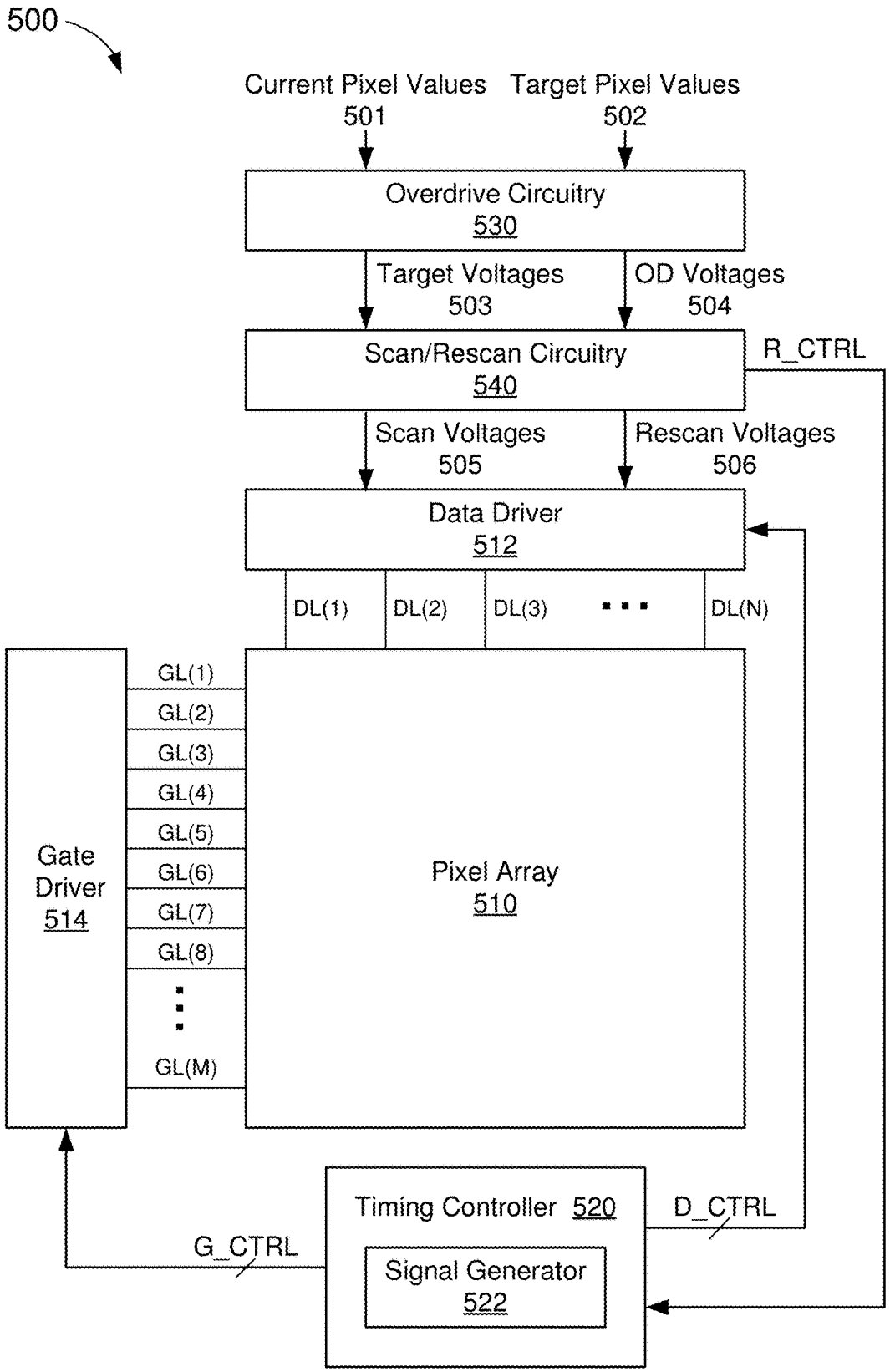
FIG. 5 shows a block diagram of a display device with overdrive circuitry, in accordance with some embodiments.

FIG. 5 shows a block diagram of a display device 500 with overdrive circuitry, in accordance with some embodiments. The display device 500 may be an example embodiment of the display device 120 of FIG. 1 or the display device 300 of FIG. 3. The display device 500 may include a pixel array 510, a timing controller 520, overdrive circuitry 530, and scan/rescan circuitry 540. In some embodiments, the display device 500 may correspond to an LCD display panel. The pixel array 510 may comprise a plurality of pixel elements (not shown for simplicity). Each row of pixel elements is coupled to a respective gate line (GL), and each column of pixel elements is coupled to a respective data line (DL).

A data driver 512 is coupled to the pixel array 510 via the data lines DL(1)-DL(N). In some aspects, the data driver 512 may be configured to drive pixel data (e.g., in the form of a corresponding voltage) to individual pixel elements, via the data lines DL(1)-DL(N), to update a frame or image displayed by the pixel array 510. It is noted that each row of pixel elements in the pixel array 510 is coupled to the same data lines DL(1)-DL(N). Thus, the display device 500 may update the pixel array 510 by successively scanning the rows of pixel elements (e.g., one row at a time).

A gate driver 514 is coupled to the pixel array 510 via the gate lines GL(1)-GL(M). In some aspects, the gate driver 514 may be configured to select which row of pixel elements is to receive the pixel data driven by the data driver 512 at any given time. For example, the gate driver 514 may select or activate each of the gate lines GL(1)-GL(M), in succession, until each row of the pixel array 510 has been updated.

The timing controller 520 is configured to control a timing of the data driver 512 and the gate driver 514. For example, the timing controller 520 may generate a first set of timing control signals (D_CTRL) to control activation of the data lines DL(1)-DL(N) by the data driver 512. The timing controller 520 may also generate a second set of timing control signals (G_CTRL) to control activation of the gate lines GL(1)-GL(M) by the gate driver 514. The timing controller 520 may generate the D_CTRL and G_CTRL signals based on a reference clock signal generated by a signal generator 522.

The overdrive circuitry 530 may determine pixel voltages to be applied to each of the pixel elements in the pixel array 510 based, at least in part, on current pixel values 501 and target pixel values 502 for each pixel element in the array 510. For example, the current pixel values 501 and target pixel values 502 may be retrieved from a frame buffer memory (such as display memory 330 of FIG. 3). More specifically, for each pixel element of the array 510, the overdrive circuitry 530 may compare the current pixel value 501 (e.g., the pixel value from a previous frame update) to the target pixel value 502 (e.g., the pixel value for the next frame update) to determine the amount of voltage to be applied to the pixel element to effect the desired change in pixel value within a frame update period.

In some embodiments, the overdrive circuitry 530 may determine target voltages 503 for each of the pixel elements in the array 510. As described above, the target voltage 503 for a particular pixel element causes the pixel element to settle at its target pixel value 502. However, if the change in pixel value exceeds a threshold amount, the target voltage 503 may be insufficient to drive the pixel element to the desired pixel value within a given frame update period. In other words, the pixel element may not have sufficient time to settle at its target pixel value 502. Thus, in some embodiments, the overdrive circuitry 530 may determine an overdrive voltage 504 to be applied to one or more pixel elements in the array 510. As described above, the overdrive voltage 504 may exceed (e.g., may be higher or lower than) the target voltage 503 for a pixel element, thus causing the pixel element to transition (e.g., rotate) faster towards its target pixel value.

Aspects of the present disclosure recognize that, although an overdrive voltage may cause a pixel element to reach its target pixel value in a shorter duration, the overdrive voltage also causes the pixel element to overshoot the target pixel value. In other words, the pixel element may eventually settle at a pixel value that is different than its target pixel value. This may further complicate the pixel voltage calculations between successive frames. For example, as described above, the amount of overdrive to be applied to a particular pixel element depends on the amount of change from its current pixel value 501 to its target pixel value 502. However, after an overdrive value has been applied to the pixel element, its current pixel value 501 depends on its pixel value from a previous frame.

With reference for example to FIG. 2, during the third pixel adjustment period (e.g., from times $t_6$ to $t_8$), the pixel voltage to be applied to a particular pixel element may depend on the target pixel value to be reached by the start of the next display period (e.g., at time $t_8$) as well as its current pixel value (e.g., between times $t_6$ to $t_7$). If an overdrive voltage was applied to the pixel element during the second pixel adjustment period (e.g., from times $t_3$ to $t_5$), the current pixel value for the pixel element may be different than its target pixel value for the previous frame. More specifically, the current pixel value of the pixel element (e.g., during the third pixel adjustment period) may depend on its target pixel value from the second pixel adjustment period as well as its target pixel value from the first pixel adjustment period (e.g., from times $t_0$ to $t_2$). However, due to memory limitations, it may not be practical (or feasible) for a display device to store two or more previously-received frames of display data.

Thus, in some embodiments, the display device 500 may reduce the complexity of pixel voltage calculations by causing each of the pixel elements in the pixel array 510 to settle at its target voltage 503. For example, during an initial scan of the pixel array 510, the display device 500 may apply overdrive voltages 504 to one or more pixel elements in the array 510. The display device 500 may then rescan at least a portion of the pixel array 510 by applying a respective target voltage 503 to any overdriven pixel elements (e.g., pixel elements to which an overdrive voltage was applied) from the initial scan. Because each pixel element is adjusted to its target pixel value at the end of each pixel adjustment period, its current pixel value 501 for the next frame may be equal to its target pixel value 502 from the previous frame. Accordingly, the image buffer memory (e.g., display memory 330 of FIG. 3) may store only the current frame of display data (e.g., from which the target pixel values 502 are derived) and a previous frame of display data (e.g., from which the current pixel values 501 are derived).

In some embodiments, the scan/rescan circuitry 540 may generate scan voltages 505 and rescan voltages 506 based on the target voltages 503 and the overdrive voltages 504. For example, a respective scan voltage 505 may be applied to each pixel element in the pixel array 510 during the initial scan of the array 510. Thus, the scan voltages 505 may include overdrive voltages 504 for any pixel elements that are unable to settle to their target pixel values by the start of the next display period. Furthermore, the rescan voltages 506 may be used to drive each overdriven pixel element (e.g., from the initial scan) to its target voltage 503. Accordingly, the rescan voltages 506 may include only the target voltages 503 for one or more pixel elements.

Aspects of the present disclosure recognize that, in many instances, it may not be practical (or feasible) to scan and rescan every row of the pixel array before the next display period. Thus, in some embodiments, the display device 500 may drive at least some of the pixel elements in the pixel array 510 to their target voltages 503 during the initial scan, while driving only a smaller subset of pixel elements to their overdrive voltages 504. In other words, the scan voltages 505 may include target voltages 503 for at least some of the pixel elements in the array 510 and overdrive voltages 504 for other pixel elements in the array 510. Accordingly, the display device 500 may rescan only the subset of rows of the pixel array 510 that contain overdriven pixel elements. In some embodiments, the scan/rescan circuitry 540 may provide a rescan control signal (R_CTRL) to the timing controller 520 indicating the subset of rows to be rescanned. Thus, during the rescanning operation, the timing controller 520 may successively activate only the subset of rows indicated by the rescan control signal to be driven with rescan voltages 506.

Figure 6:
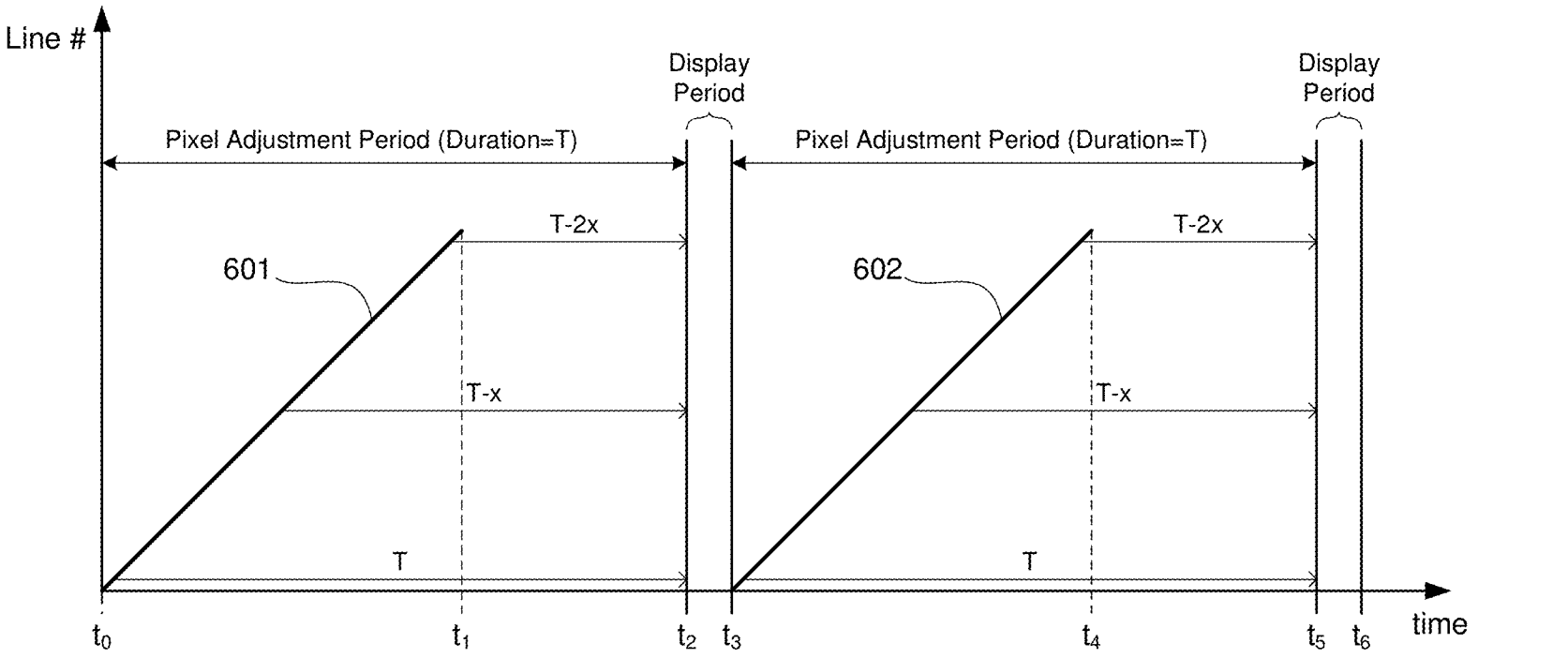
FIG. 6 shows a timing diagram depicting an example timing of pixel updates in a display device.

FIG. 6 shows a timing diagram depicting 600 an example timing of pixel updates in a display device. The display device may be an example embodiment of display device 120, 300, or 500 of FIGS. 1, 3, and 5, respectively. With reference for example to FIG. 5, images may be periodically displayed by the pixel array 510 during successive frame update intervals. Each frame update interval (e.g. from times $t_0$ to $t_3$ and $t_3$ to $t_6$) may comprise a pixel adjustment period (e.g., from times $t_0$ to $t_2$ and $t_3$ to $t_5$) followed by a display period (e.g., from times $t_2$ to $t_3$ and $t_5$ to $t_6$). During each pixel adjustment period, the pixel array 510 may be driven with pixel updates (e.g., from times $t_0$ to $t_1$ and $t_3$ to $t_4$). The updated pixel elements are then "displayed" (e.g. made viewable) to the user during the following display period. For example, the image on the pixel array 510 may be displayed to the user by activating a light source configured to illuminate the pixel array 510 (such as the backlight 124 of FIG. 1).

During each pixel adjustment period, individual rows of the pixel array 510 may be successively updated (e.g., in a cascaded fashion). The curves 601 and 602 show example pixel update times for each row of the pixel array 510 based on the line number associated with that row. Thus, as shown in FIG. 6, rows associated with higher line numbers (e.g., further down the cascade) are updated later than rows associated with lower line numbers (e.g., towards the start of the cascade). However, because the pixel elements are illuminated only during the display periods, any changes in pixel value exhibited before or after the display period will not be seen by the user. As a result, pixel elements associated with higher line numbers (e.g., pixel elements that are updated later in the cascade) have less time to transition to their desired pixel values than pixel elements associated with lower line numbers (e.g., pixel elements that are updated earlier in the cascade). For example, pixel elements at the top of the pixel array 510 may have the duration (T) of the pixel adjustment period to reach their target pixel values. In contrast, pixel elements in the middle of the array 510 may have a significantly shorter duration (T−x) to reach their target pixel values, and pixel elements at the bottom of the array 510 may have an even shorter duration (T−2x) to reach their target pixel values.

Aspects of the present disclosure recognize that, due to the differences in transition times for the various rows of the pixel array 510, different amounts of overdrive may be applied to different rows of pixel elements. For example, pixel elements associated with relatively low line numbers may require little or no overdrive to reach their target pixel values before the next display period. However, pixel elements associated with higher line numbers may require progressively more overdrive voltage to reach their target pixel values before the next display period. Thus, in some embodiments, the overdrive circuitry 530 may progressively increase the amount of overdrive applied to the rows of pixel elements based, at least in part, on their position (e.g., line number) in the array 510. More specifically, pixel elements that are associated with higher line numbers (e.g. updated later during the display update interval) are generally provided with greater amounts of overdrive voltage than pixel elements that are associated with lower line numbers (e.g., updated earlier during the display update interval).

Figure 7B:
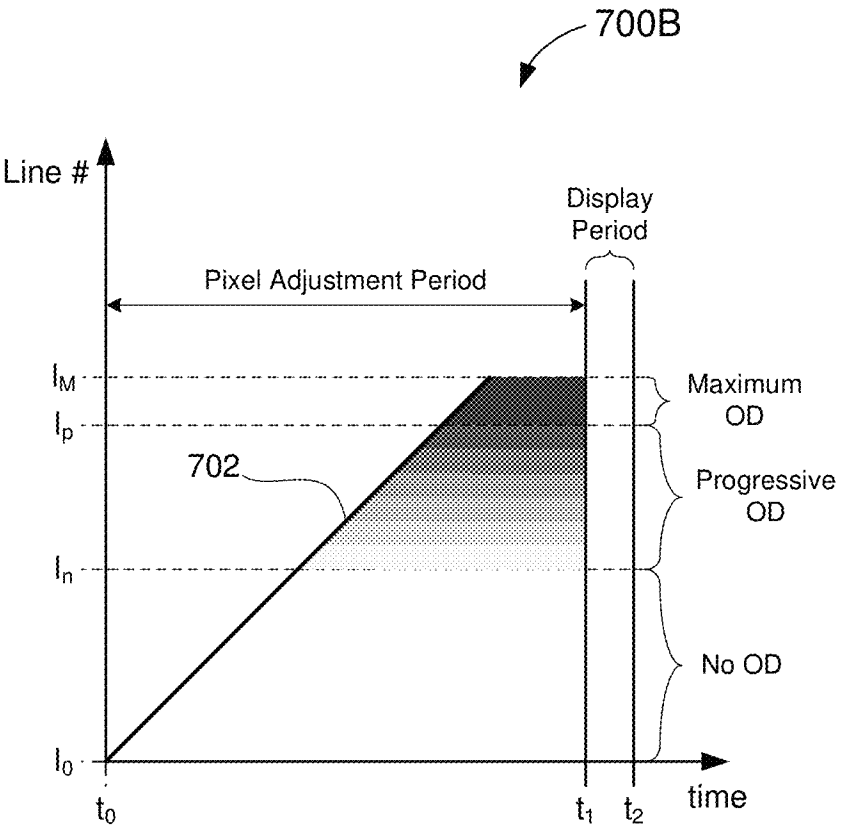
FIGS. 7A and 7B show timing diagrams depicting example implementations of progressive overdrive, in accordance with some embodiments.
Figure 7A:
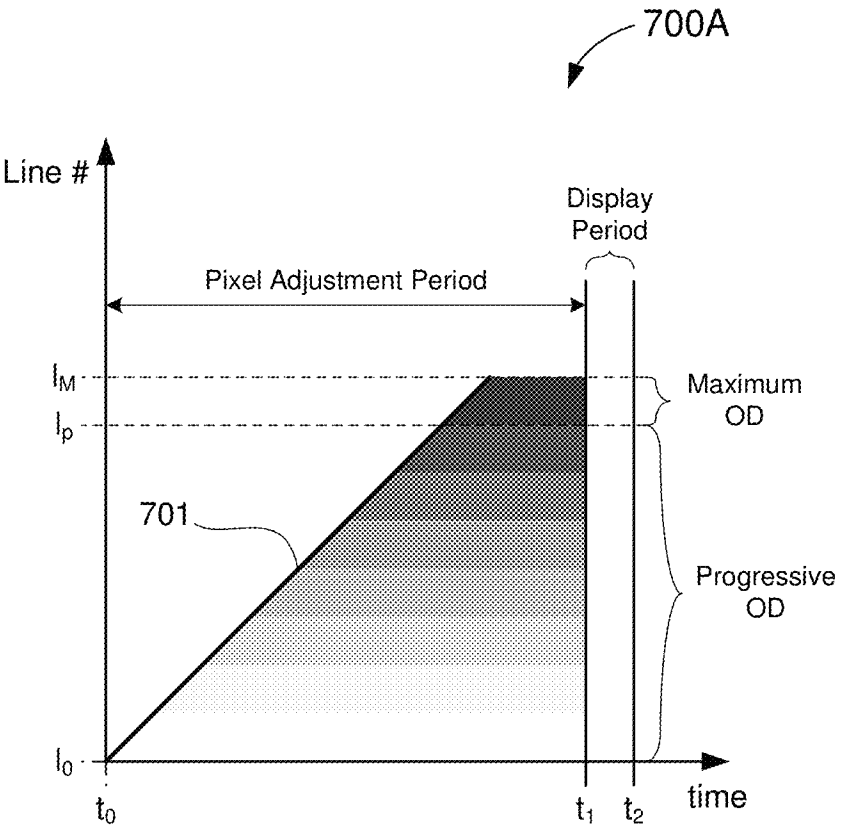

FIG. 7A shows a timing diagram 700A depicting an example implementation of progressive overdrive, in accordance with some embodiments. In some embodiments, the method of progressive overdrive illustrated in FIG. 7A may be implemented by the overdrive circuitry 530 of FIG. 5. The timing diagram 700A shows an example frame update interval (e.g. from times $t_0$ to $t_2$) which may comprise a pixel adjustment period (e.g., from times $t_0$ to $t_1$) followed by a display period (e.g., from times $t_1$ to $t_2$). The curve 701 depicts example pixel update times for each row of the pixel array 510 based on the line number associated with that row.

In the example of FIG. 7A, the overdrive circuitry 530 may generate progressive overdrive voltages for successive rows of pixel elements between lines $l_0$ to $l_p$ of the pixel array 510. More specifically, the amount of overdrive voltage may be progressively increased for each successive row of pixel elements from lines $l_0$ to $l_p$. For example, a pixel element coupled to line $l_p$ may be driven to a higher voltage than a pixel element coupled to line $l_0$ to effect the same change in pixel value (e.g., same change in grayscale level) before the start of the display period. In some aspects, the amount of overdrive that can be applied to the pixel elements may be limited by the voltage range of the data driver 512. In the example of FIG. 7A, the overdrive voltage may become saturated by the time the pixel elements coupled to line $l_p$ are updated. Thus, the overdrive circuitry 530 may apply maximum overdrive to the rows of pixel elements between lines $l_p$ and $l_M$ of the pixel array 510. In other words, if any of the pixel elements between lines $l_p$ and $l_M$ are to be updated during the pixel adjustment period, the overdrive circuitry 530 may apply the maximum overdrive voltage to change the pixel values of such pixel elements.

Aspects of the present disclosure recognize that the need for progressive overdrive may vary depending on the characteristics of the LCD display (e.g., number of pixels, temperature, response time, etc.). For example, an LCD display with fewer pixel elements (or at least fewer lines of pixels) may require less time to update the entire pixel array. Thus, the change in overdrive from one row of pixel elements to another may be more gradual in a smaller pixel array. Aspects of the present disclosure further recognize that, in some embodiments, one or more rows of pixel elements may settle to their target pixel values, before the next display period, without the use of overdrive (e.g., by driving the pixel elements only up to the target voltage).

FIG. 7B shows a timing diagram 700B depicting another example implementation of progressive overdrive, in accordance with some embodiments. In some embodiments, the method of progressive overdrive illustrated in FIG. 7B may also be implemented by the overdrive circuitry 530 of FIG. 5. The timing diagram 700B shows an example frame update interval (e.g. from times $t_0$ to $t_2$) which may comprise a pixel adjustment period (e.g., from times $t_0$ to $t_1$) followed by a display period (e.g., from times $t_1$ to $t_2$). The curve 702 depicts example pixel update times for each row of the pixel array 510 based on the line number (e.g., gate line) associated with that row.

In the example of FIG. 7B, the overdrive circuitry 530 may not apply any overdrive to the rows of pixel elements between lines $l_0$ and $l_n$ of the pixel array 510. Rather, each pixel element between lines $l_0$ and $l_n$ may be driven to its target voltage during the pixel adjustment period. The overdrive circuitry 530 may generate progressive overdrive voltages for successive rows of pixel elements between lines $l_n$ to $l_p$ of the pixel array 510. As described above, the amount of overdrive voltage may be progressively increased for each successive row of pixel elements from lines $l_n$ to $l_p$.

In the example of FIG. 7B, the overdrive voltage may become saturated by the time the pixel elements coupled to line $l_p$ are updated. Thus, the overdrive circuitry 530 may apply maximum overdrive to the rows of pixel elements between lines $l_p$ and $l_M$ of the pixel array 510. In other words, if any of the pixel elements between lines $l_p$ and $l_M$ are to be updated during the pixel adjustment period, the overdrive circuitry 530 may apply the maximum overdrive voltage to change the pixel values of such pixel elements.

By applying overdrive in a progressive manner (e.g., as shown in FIGS. 7A and 7B), the overdrive circuitry 530 may ensure that each of the pixel elements in the array 510 is updated to its target pixel value (or at least a pixel value that is substantially close to the target pixel value) before the next display period. Furthermore, by selectively applying overdrive to only a portion of the pixel array (e.g., as shown in FIG. 7B), the embodiments herein may reduce the amount of resources (e.g., memory, time, power, and other processing resources) needed to generate the overdrive voltages for the pixel array 510.

Figure 8:
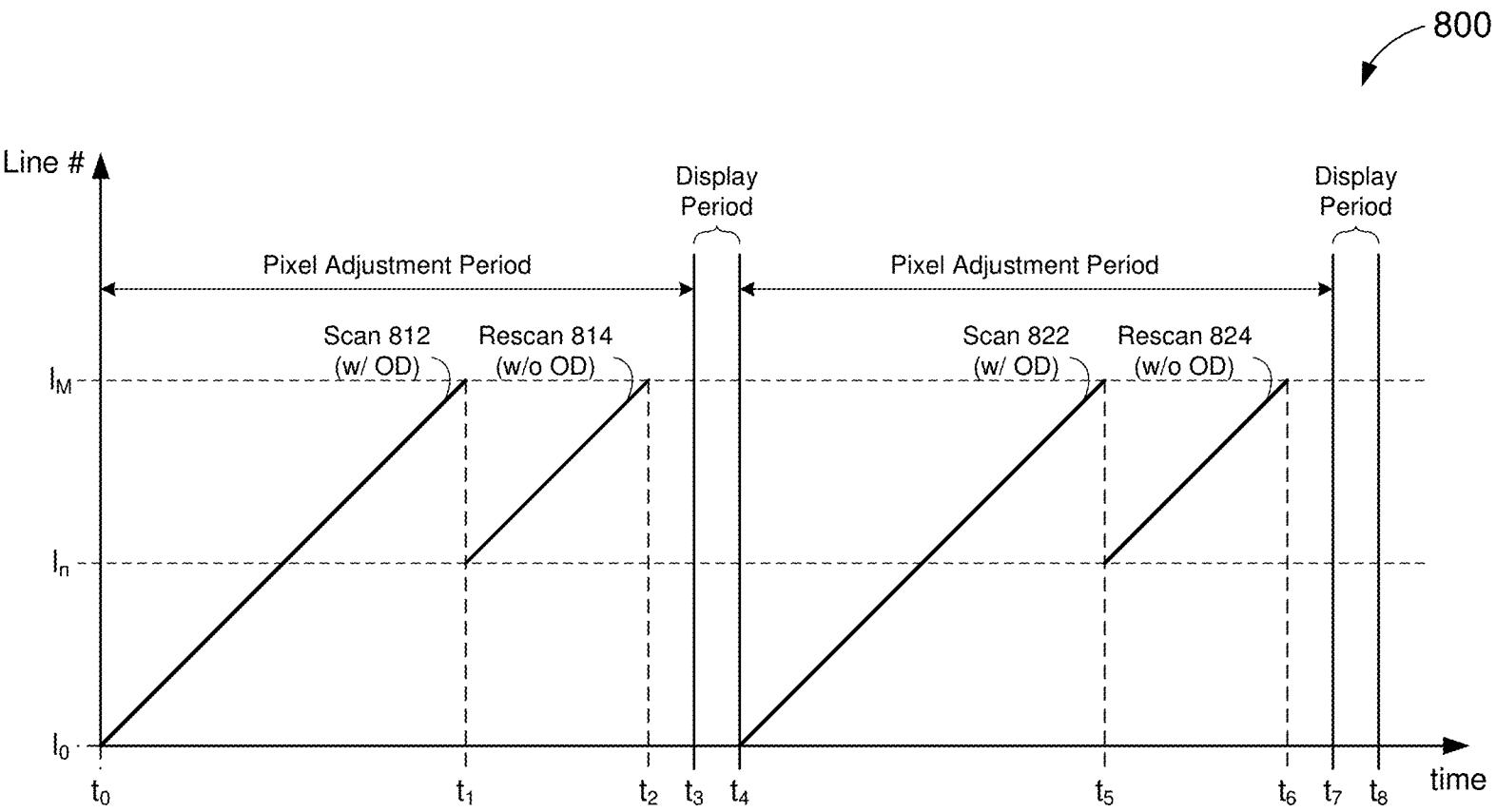
FIG. 8 shows a timing diagram depicting an example overdrive correction operation, in accordance with some embodiments.

FIG. 8 shows a timing diagram 800 depicting an example overdrive correction operation, in accordance with some embodiments. In some embodiments, the overdrive correction operation illustrated in FIG. 8 may be implemented by any of the display devices 120, 300, or 500 of FIGS. 1, 3, and 5, respectively. With reference for example to FIG. 5, images may be periodically displayed by the pixel array 510 during successive frame update intervals. Each frame update interval (e.g. from times $t_0$ to $t_4$ and $t_4$ to $t_8$) may comprise a pixel adjustment period (e.g., from times $t_0$ to $t_3$ and $t_4$ to $t_7$) followed by a display period (e.g., from times $t_3$ to $t_4$ and $t_7$ to $t_8$).

During each pixel adjustment period, individual rows of the pixel array 510 may be successively updated. The curves 812, 814, 822, and 824 show example pixel update times for corresponding rows of the pixel array 510 based on the line number associated with each row. More specifically, curve 812 corresponds to an initial scan of the pixel array 510 (e.g., from times $t_0$ to $t_1$) and curve 814 corresponds to a rescan of the pixel array 510 (e.g., from times $t_1$ to $t_2$) during a first pixel adjustment period (e.g., from times $t_0$ to $t_3$). Similarly, curve 822 corresponds to an initial scan of the pixel array (e.g., from times $t_4$ to $t_5$) and curve 824 corresponds to a rescan of the pixel array 510 (e.g., from times $t_5$ to $t_6$) during a second pixel adjustment period (e.g., from times $t_4$ to $t_7$). In some embodiments, the display device 500 may use dithering techniques to hide any unwanted edges that may occur between an initial scan and a rescan.

In the example of FIG. 8, the overdrive circuitry 530 may not apply any overdrive to the rows of pixel elements between lines $l_0$ and $l_n$ of the pixel array 510. Thus, each pixel element between lines $l_0$ and $l_n$ may be driven to its target voltage during the initial scans 812 and 822. The overdrive circuitry 530 may generate overdrive voltages for each row of pixel elements between lines $l_n$ to $l_M$ of the pixel array 510. In some embodiments, the amount of overdrive voltage may be progressively increased for each successive row of pixel elements from lines $l_n$ to $l_M$. Thus, each pixel element between lines $l_n$ and $l_M$ may be driven to a respective overdrive voltage during the initial scans 812 to 822. Since overdrive voltages are applied to only a subset of rows of the pixel array 510 (e.g., lines $l_n$ to $l_M$), each rescan 814 and 824 may be limited to the corresponding subset of rows of the pixel array 510. More specifically, each pixel element between lines $l_n$ and $l_M$ may be driven to its target voltage during the rescans 814 and 824.

It is noted that, after the rescan 814, each of the pixel elements in the pixel array 510 (e.g., from lines $l_0$ to $l_M$) may settle at its target pixel value. Thus, the overdrive circuitry 530 may use the target pixel values from the first pixel adjustment period (e.g., as the current pixel values) to calculate the overdrive voltages to be applied during the second pixel adjustment period. Accordingly, the present embodiments provide the benefit of faster pixel transitions times (e.g., by applying overdrive voltages to at least some of the pixel elements during the initial scans 812 and 822) while also reducing the storage requirements and computational complexity of deriving the pixel voltages to be applied in subsequent frame updates (e.g., by applying target voltages to the overdriven pixel elements during the rescans 814 and 824).

Foveal Rendering

As described above, head-mounted display (HMD) devices are configured to be worn on, or otherwise affixed to, a user's head. An HMD device may comprise one or more displays positioned in front of one, or both, of the user's eyes. The HMD device may display images (e.g., still images, sequences of images, and/or videos) from an image source overlaid with information and/or images from the user's surrounding environment (e.g., as captured by a camera), for example, to immerse the user in a virtual world.

In some implementations, a display device (such as an HMD device) may display a dynamically-updated image to a user based on the user's eye position. More specifically, the display device may track the user's eye movements and may display a portion of the image coinciding with a fixation point of the user (e.g., foveal region) with higher resolution than other regions of the image (e.g., the full field-of-view image). Thus, in some embodiments, the display device may display or render a high-resolution foveal image as an overlay in the foveal region of the full field-of-view (FFOV) image.

Figure 9:
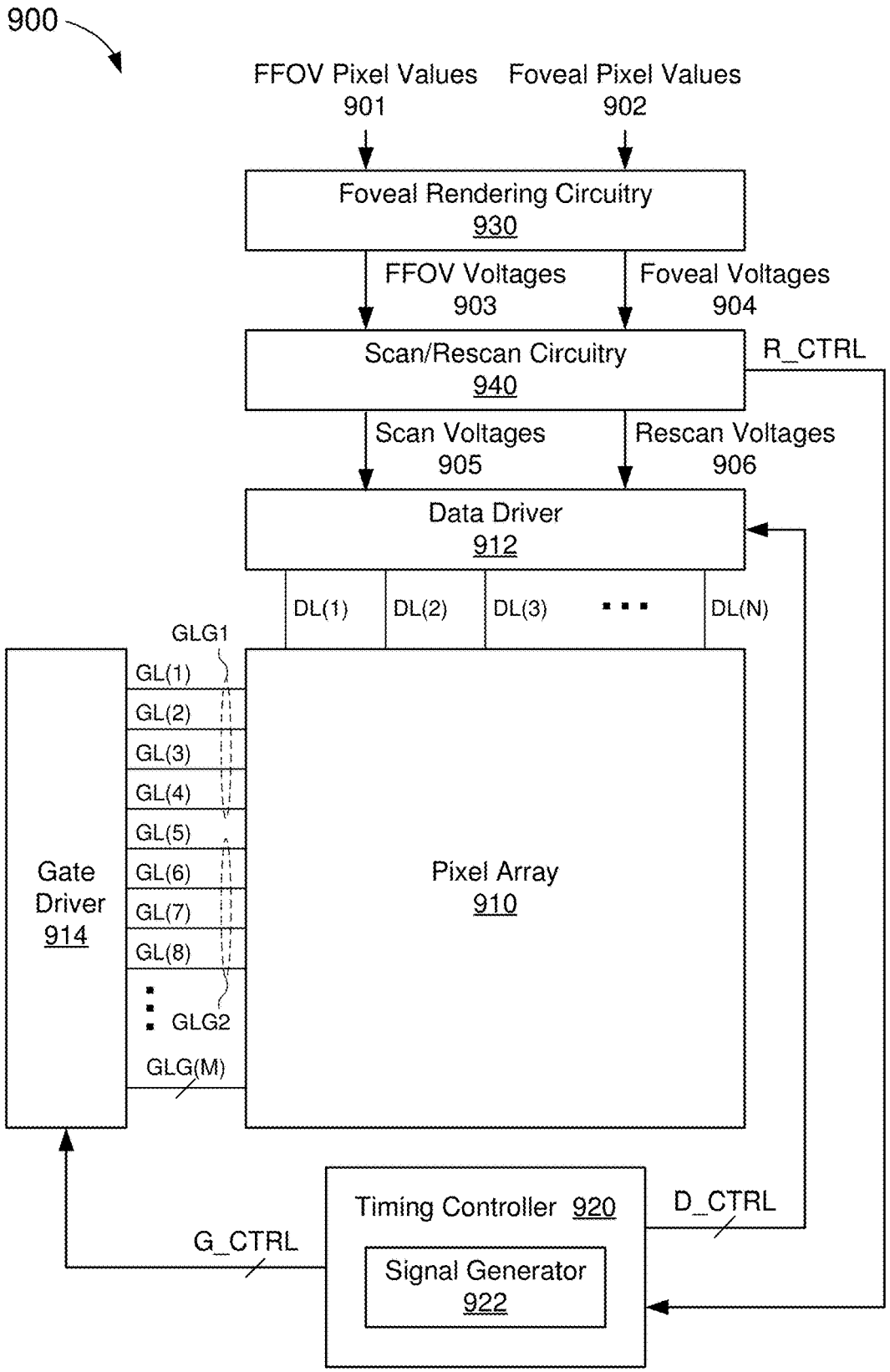
FIG. 9 shows a block diagram of a display device with foveal rendering circuitry, in accordance with some embodiments.

FIG. 9 shows a block diagram of a display device 900 with foveal rendering circuitry, in accordance with some embodiments. The display device 900 may be an example embodiment of the display device 120 of FIG. 1 or the display device 300 of FIG. 3. The display device 900 may include a pixel array 910, a timing controller 920, foveal rendering circuitry 930, and scan/rescan circuitry 940. In some embodiments, the display device 900 may correspond to an LCD display panel. The pixel array 910 may comprise a plurality of pixel elements (not shown for simplicity). Each row of pixel elements is coupled to a respective gate line (GL), and each column of pixel elements is coupled to a respective data line (DL).

A data driver 912 is coupled to the pixel array 910 via the data lines DL(1)-DL(N). In some aspects, the data driver 912 may be configured to drive pixel data (e.g., in the form of a corresponding voltage) to individual pixel elements, via the data lines DL(1)-DL(N), to update a frame or image displayed by the pixel array 910. It is noted that each row of pixel elements in the pixel array 910 is coupled to the same data lines DL(1)-DL(N). Thus, the display device 900 may update the pixel array 910 by successively scanning the rows of pixel elements (e.g., one row at a time).

A gate driver 914 is coupled to the pixel array 910 via the gate lines GL(1)-GL(M). In some aspects, the gate driver 914 may be configured to select which row of pixel elements is to receive the pixel data driven by the data driver 912 at any given time. For example, the gate driver 914 may select or activate each of the gate lines GL(1)-GL(M), in succession, until each row of the pixel array 910 has been updated.

The timing controller 920 is configured to control a timing of the data driver 912 and the gate driver 914. For example, the timing controller 920 may generate a first set of timing control signals (D_CTRL) to control activation of the data lines DL(1)-DL(N) by the data driver 912. The timing controller 920 may also generate a second set of timing control signals (G_CTRL) to control activation of the gate lines GL(1)-GL(M) by the gate driver 914. The timing controller 920 may generate the D_CTRL and G_CTRL signals based on a reference clock signal generated by a signal generator 922.

The foveal rendering circuitry 930 may determine pixel voltages to be applied to each of the pixel elements in the pixel array 910 based, at least in part, on FFOV pixel values 901 and foveal pixel values 902 from a received frame of display data. For example, the FFOV pixel values 901 and foveal pixel values 902 may be retrieved from a frame buffer memory (such as display memory 330 of FIG. 3). In some aspects, the FFOV pixel values 901 may correspond to an FFOV image and the foveal pixel values 902 may correspond to a foveal image to be displayed in combination with the FFOV image. For example, the FFOV image may be rendered at a relatively low resolution and the foveal image rendered at a relatively high resolution and positioned within the FFOV image.

Figure 10:
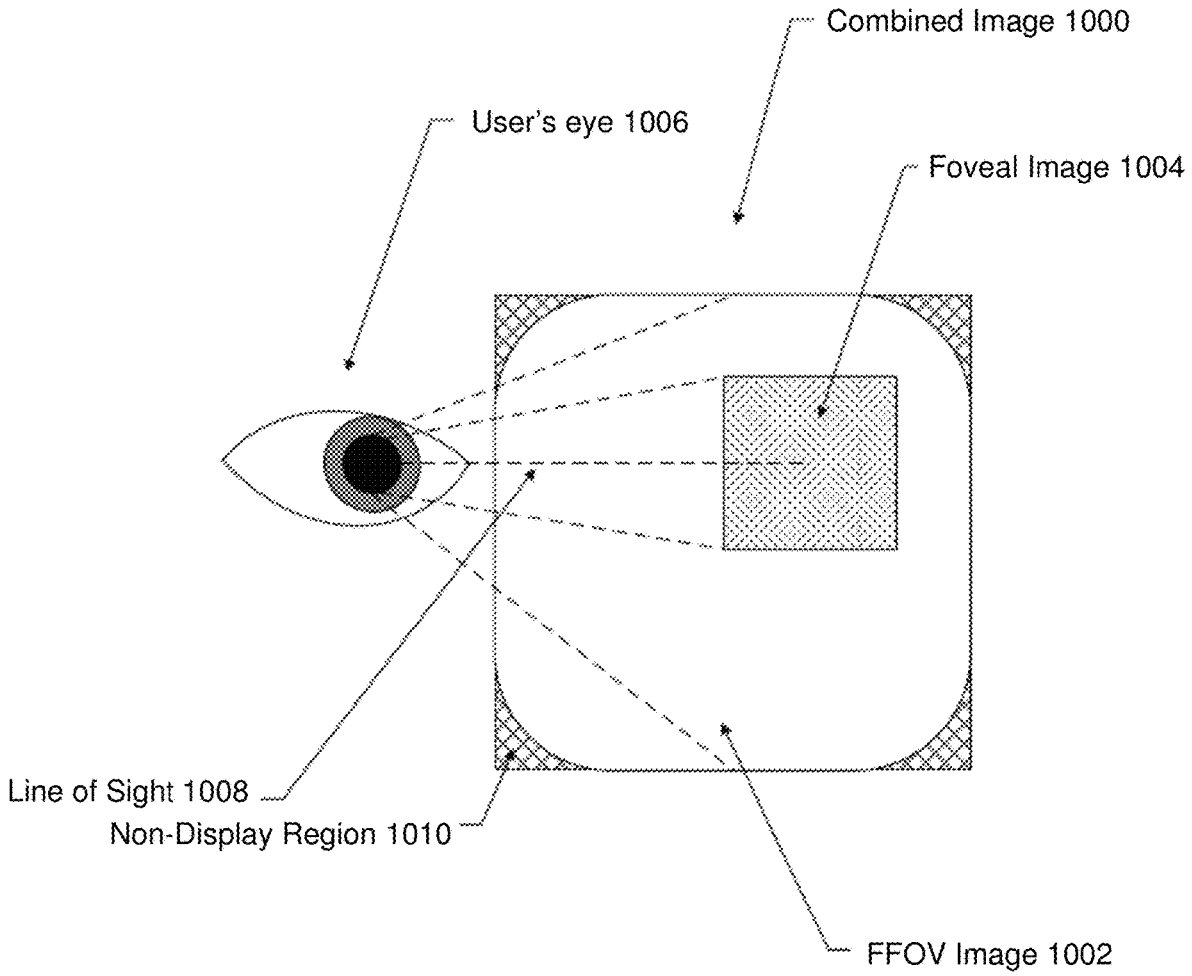
FIG. 10 shows an example image that may be displayed on a display device, in accordance with some embodiments.

For example, FIG. 10 shows a combined image 1000 that can be displayed on the pixel array 910. The combined image 1000 is shown to include a foveal image 1004 merged with an FFOV image 1002. The FFOV image 1002 spans the periphery of the user's line of sight 1008. Thus, the FFOV image 1002 may correspond with the full-frame image to be displayed across most (if not all) of the pixel elements in the pixel array 910. For example, in a virtual reality environment, the FFOV image 1002 may show the extent of the observable virtual or real world that is seen by the user's eyes 1006 at any given moment. In contrast, the foveal image 1004 spans only the foveal region of the user's line of sight 1008. The foveal region may correspond to the portion of the combined image 1000 that is viewable by the fovea centralis portion of the user's eye 1006 (e.g., the region in which the user is determined to have maximal visual acuity at any given moment).

As shown in FIG. 10, the foveal image 1004 may encompass a relatively small portion of the combined image 1000 compared to the FFOV image 1002. More specifically, when generating the combined image 1000, the foveal image 1004 may be overlaid upon a portion of the FFOV image 1002 (e.g., coinciding with the foveal region of the user's line of sight 1008). Because the foveal image 1004 spans a region in which the user has maximal visual acuity, the foveal image 1004 may be rendered at a higher resolution than the FFOV image 1002. For example, each pixel of the foveal image 1004 may be rendered on a respective pixel element of the pixel array 910. In contrast, each pixel of the FFOV image 1002 may be rendered across a plurality of pixel elements of the pixel array 910. Accordingly, the foveal image 1004 may appear sharper than the FFOV image 1002 in the combined image 1000.

Referring back to FIG. 9, the foveal rendering circuitry 930 may determine FFOV voltages 903 and foveal voltages 904 to be applied to the pixel array 910 based on the FFOV pixel values 901 and foveal pixel values 902, respectively. More specifically, the FFOV voltages 903 and foveal voltages 904 may correspond to target voltages associated with the FFOV pixel values 901 and foveal pixel values 902. For example, the FFOV pixel values 901 may correspond with a full-frame image (e.g., FFOV image 1002) to be displayed across most (if not all) of the pixel elements of the pixel array 910. Since the FFOV image may span the periphery of the user's line of sight, the FFOV pixel values 901 may have a relatively low resolution. In contrast, the foveal pixel values 902 may correspond with a foveal image (e.g., foveal image 1004) that spans only the foveal region of the user's line of sight. Since the foveal region may correspond to the region in which the user is determined to have maximal visual acuity, the foveal pixel values 902 may have a relatively high resolution.

Figure 11:
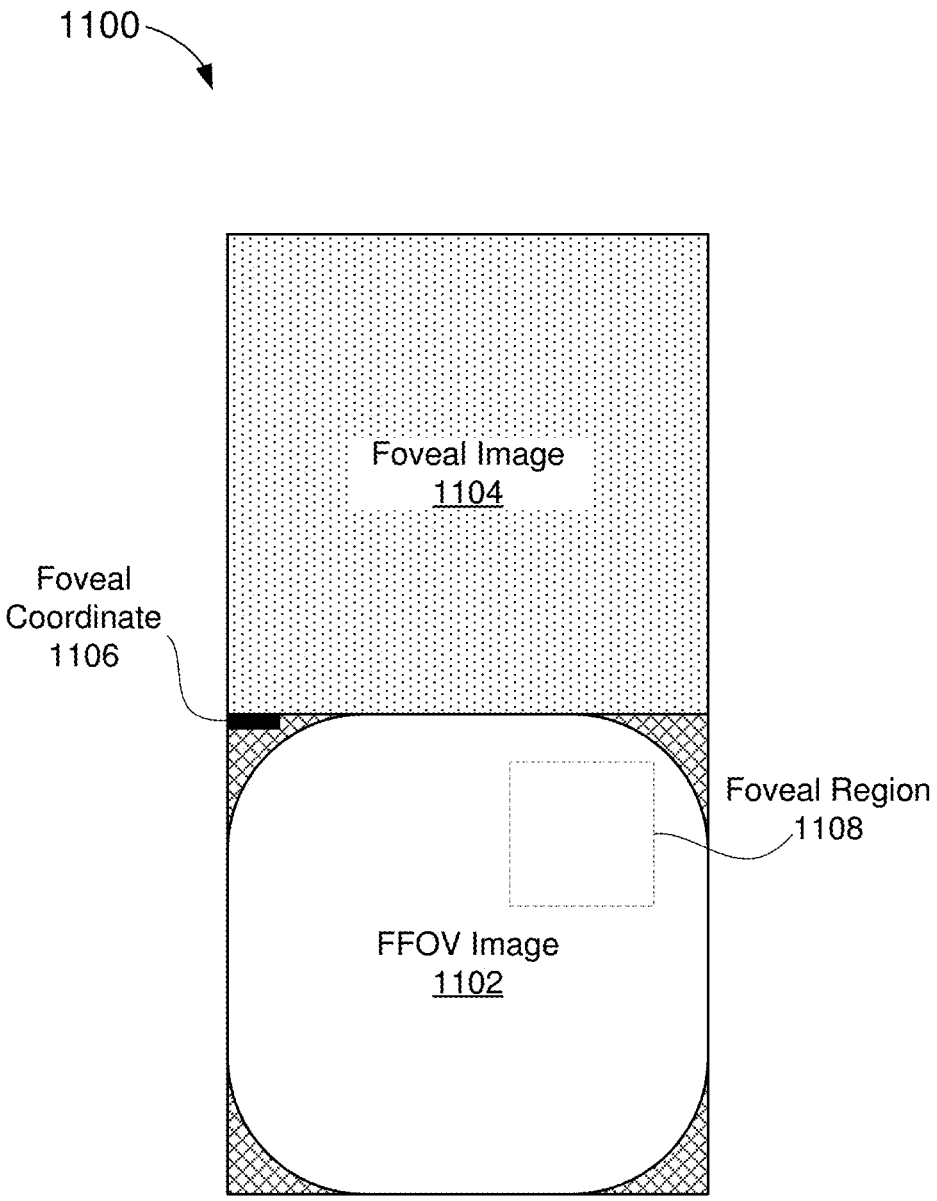
FIG. 11 shows an example frame buffer image, in accordance with some embodiments.

Aspects of the present disclosure recognize that the amount of bandwidth and memory needed to receive and store a respective pixel value for each pixel of the combined image 1000 may also be prohibitively expensive. Thus, in some embodiments, the display device 900 may receive the FFOV image 1002 and the foveal image 1004 separately in the same frame buffer image. For example, FIG. 11 shows an example frame buffer image 1100 that may be received by the display device 900. The frame buffer image 1100 includes an FFOV image 1102 and a foveal image 1104. For example, the FFOV image 1102 and the foveal image 1104 may correspond to the FFOV image 1002 and foveal image 1004, respectively, of FIG. 10.

In the example of FIG. 11, the FFOV image 1102 may be encoded in a first portion of the frame buffer image 1100 and the foveal image 1104 may be encoded in a second portion of the frame buffer image 1100. Accordingly, the FFOV image 1102 and the foveal image 1104 may be received sequentially by the display device 900. In some embodiments, the FFOV image 1102 is not upscaled to the resolution at which it is to be displayed (e.g., as shown in FIG. 10). Rather, the FFOV image 1102 and the foveal image 1104 are each transmitted in their "native" resolutions. This may substantially reduce the bandwidth needed to transmit and store the frame buffer image 1100.

In some embodiments, a set of foveal coordinates 1106, specifying the foveal region 1108 of the FFOV image 1102, may be encoded in the frame buffer image 1100. For example, the display device 900 may determine, based on the foveal coordinates 1106, where to overlay the foveal image 1104 with respect to the FFOV image 1102 when rendering a combined image on the pixel array 910. The foveal coordinates 1106 may identify at least one pixel location associated with the foveal region 1108 of the FFOV image 1102. For example, in some aspects, the foveal coordinates 1106 may identify the pixel in a particular corner, or center, of the foveal region. In some other aspects, the foveal coordinates 1106 may identify a set of pixels defining a boundary of the foveal region.

In some embodiments, the foveal coordinates 1106 may be encoded in a portion of the frame buffer image 1100 coinciding with a non-display region 1010 of the FFOV image 1102. In the example of FIG. 11, the foveal coordinates 1106 are encoded in the upper-left corner of the frame buffer image 1100. In some embodiments, the foveal coordinates 1106 may be encoded as pixel data. For example, the foveal coordinates 1106 may be encoded using the first 32 pixels of the frame buffer image 1100. In some implementations, the foveal coordinates 1106 may be encoded using a 2-bits per pixel sparse encoding technique. For example, bits "00" may be encoded as a black pixel, bits "01" may be encoded as a red pixel, bits "10" may be encoded as a green pixel, and bits "11" may be encoded as a white pixel.

In some embodiments, each pixel of the FFOV image 1102 may correspond to a respective FFOV pixel value 901 and each pixel of the foveal image 1104 may correspond to a respective foveal pixel value 902. Since the FFOV image 1102 is to be displayed at an up-scaled resolution, the foveal rendering circuitry 930 may associate each FFOV pixel value 901 with a plurality of FFOV voltages 903 (e.g., to be applied to respective pixel elements of the pixel array 910). On the other hand, because the foveal image is to be displayed at its native (or at least close to native) resolution, the foveal rendering circuitry 930 may associate each foveal pixel value 904 with a respective foveal voltage 904 (e.g., to be applied to respective pixel elements in a portion of the pixel array 910).

Figure 12B:
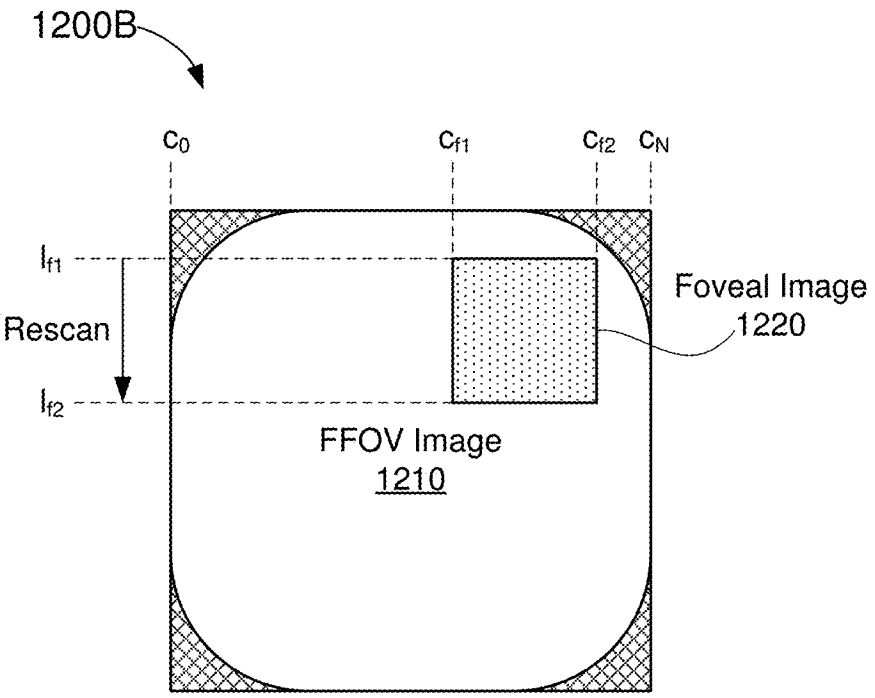
FIGS. 12A and 12B show example operations for rendering an image on a display device, in accordance with some embodiments.
Figure 12A:
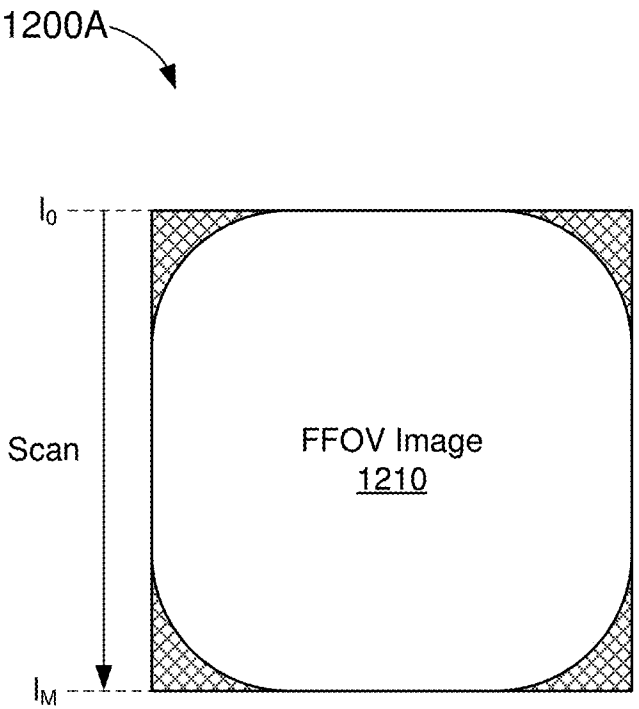

Aspects of the present disclosure further recognize that, because the resolution of the FFOV image 1102 is relatively low, it may be inefficient to perform a row-by-row scan when driving the FFOV voltages 903 onto the pixel array 910 (e.g., since multiple pixel elements may be driven with the same FFOV voltages 903). Thus, in some embodiments, the display device 900 may render the FFOV image 1102 and the foveal image 1104 on the pixel array 910 at different times and at different rates. With reference for example to FIG. 12A, the display device 900 may render an FFOV image 1210 on the pixel array 910 during an initial scanning operation 1200A. More specifically, the display device 900 may render the FFOV image 1210 by scanning each row of the pixel array 910 (e.g., from lines $l_0$ to $l_M$. With reference for example to FIG. 12B, the display device 900 may render a foveal image 1220 on the pixel array 910, as an overlay of the FFOV image 1210, during a subsequent rescanning operation 1200B. More specifically, the display device may render the foveal image 220 by rescanning only a subset of rows of the pixel array 910 corresponding to a foveal region of the FFOV image 1210 (e.g., from lines $l_{f1}$ to $l_{f2}$).

In some embodiments, the display device 900 may render the FFOV image 1210 and the foveal image 1220 on the pixel array 910 in the order in which it receives each image in a corresponding frame buffer image. As described above with respect to FIG. 11, the display device 900 may receive the FFOV image 1210 and the foveal image 1220 sequentially in the frame buffer image. Thus, the display device 900 may perform the initial scanning operation 1200A as it receives the FFOV image 1210 and may subsequently perform the rescanning operation 1200B as it receives the foveal image 1220. It is noted that the FFOV image 1210 will have already been rendered on the pixel array 910 by the time the rescanning operation 1200B is performed. Thus, at least some of the FFOV pixel values may be discarded once the initial scanning operation 1200A is completed. This may further reduce the memory requirements of the display device 900.

In some embodiments, the scan/rescan circuitry 940 may generate scan voltages 905 and rescan voltages 906 based on the FFOV voltages 903 and the foveal voltages 904. For example, a scan voltage 905 may be applied to each pixel element in the pixel array 910 during the initial scan of the array 910. Thus, each of the scan voltages 905 may correspond to a respective FFOV voltage 903. Furthermore, the rescan voltages 906 may be used to drive respective foveal voltages 904 onto each pixel element within a foveal region of the FFOV image displayed on the pixel array 910. Accordingly, the rescan voltages 905 may include foveal voltages 904 for at least some of the rescanned pixel elements. During the rescan operation, the scan/rescan circuitry 940 may reapply the FFOV voltages 903 to any pixel elements in the rescanned rows of the pixel array 910 that are outside the foveal region of the FFOV image (such as pixel elements in columns $c_0$ to $c_{f1}$ and $c_{f2}$ to $c_N$ in FIG. 12B). Thus, in some embodiments, the rescan voltages 906 may also include FFOV voltages 903 for at least some of the rescanned pixel elements.

Figure 13:
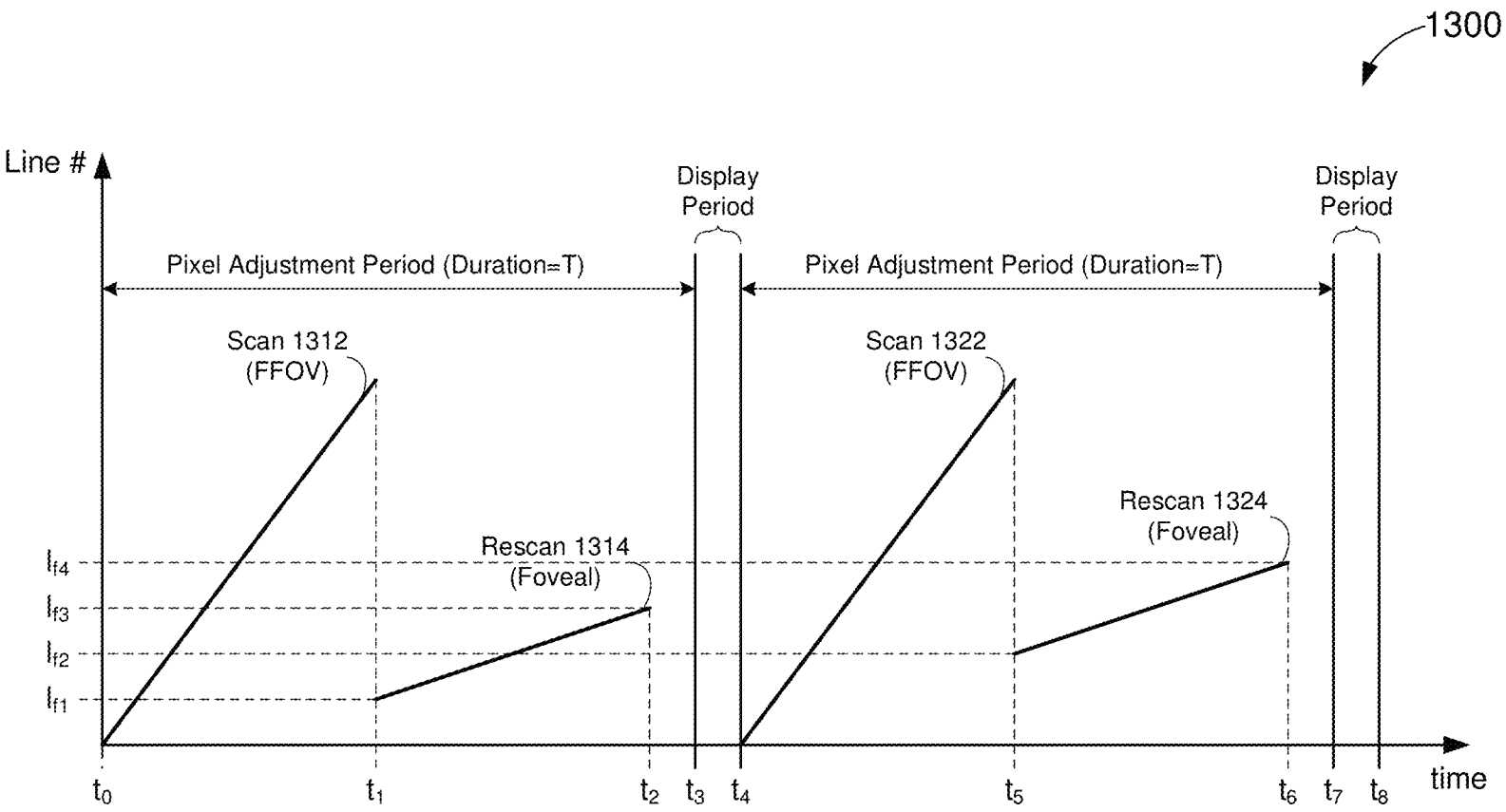
FIG. 13 shows a timing diagram depicting an example foveal rendering operation, in accordance with some embodiments.

FIG. 13 shows a timing diagram 1300 depicting an example foveal rendering operation, in accordance with some embodiments. In some embodiments, the foveal rendering operation illustrated in FIG. 8 may be implemented by any of the display devices 120, 300, or 900 of FIGS. 1, 3, and 9, respectively. With reference for example to FIG. 9, images may be periodically displayed by the pixel array 910 during successive frame update intervals. Each frame update interval (e.g. from times $t_0$ to $t_4$ and $t_4$ to $t_8$) may comprise a pixel adjustment period (e.g., from times $t_0$ to $t_3$ and $t_4$ to $t_7$) followed by a display period (e.g., from times $t_3$ to $t_4$ and $t_7$ to $t_8$).

During each pixel adjustment period, individual rows of the pixel array 910 may be successively updated. The curves 1312, 1314, 1322, and 1324 show example pixel update times for corresponding rows of the pixel array 910 based on the line number associated with each row. More specifically, curve 1312 corresponds to an initial scan of the pixel array 910 (e.g., from times $t_0$ to $t_1$) and curve 1314 corresponds to a rescan of the pixel array 910 (e.g., from times $t_1$ to $t_2$) during a first pixel adjustment period (e.g., from times $t_0$ to $t_3$). Similarly, curve 1322 corresponds to an initial scan of the pixel array (e.g., from times $t_4$ to $t_5$) and curve 1324 corresponds to a rescan of the pixel array 910 (e.g., from times $t_5$ to $t_6$) during a second pixel adjustment period (e.g., from times $t_4$ to $t_7$). In some embodiments, the display device 900 may use dithering techniques to hide any unwanted edges that may occur between an initial scan and a rescan.

A first FFOV image may be rendered on the pixel array 910 during the first pixel adjustment period. For example, the scan/rescan circuitry 940 may apply the FFOV voltages 903 (e.g., as scan voltages 905) to respective pixel elements in each row of the pixel array 910 during the initial scan 1312. A foveal image may be subsequently rendered within a foveal region of the first FFOV image. In the example of FIG. 13, the foveal region of the first FFOV image may be located between lines $l_{f1}$ and $l_{f3}$ of the pixel array 910. Thus, during the rescan 1314, the scan/rescan circuitry 940 may apply foveal voltages 904 (e.g., as rescan voltages 906) to respective pixel elements between lines $l_{f1}$ and $l_{f3}$ that are positioned within the foveal region of the FFOV image (e.g., between columns $c_{f1}$ and $c_{f2}$ in FIG. 12B). The scan/rescan circuitry 940 may further reapply the FFOV voltages 903 (e.g., as rescan voltages 906) to respective pixel elements between lines $l_{f1}$ and $l_{f3}$ that are positioned outside the foveal region of the FFOV image (e.g., between columns $c_0$ to $c_{f1}$ and $c_{f2}$ to $c_N$ in FIG. 12B).

A second FFOV image may be rendered on the pixel array 910 during the second pixel adjustment period. For example, the scan/rescan circuitry 940 may apply the FFOV voltages 903 (e.g., as scan voltages 905) to respective pixel elements in each row of the pixel array 910 during the initial scan 1322. A foveal image may be subsequently rendered within a foveal region of the second FFOV image. In the example of FIG. 13, the foveal region of the second FFOV image may be located between lines $l_{f2}$ and $l_{f4}$ of the pixel array 910. Thus, during the rescan 1324, the scan/rescan circuitry 940 may apply foveal voltages 904 (e.g., as rescan voltages 906) to respective pixel elements between lines $l_{f2}$ and $l_{f4}$ that are positioned within the foveal region of the FFOV image. The scan/rescan circuitry 940 may further reapply the FFOV voltages 903 (e.g., as rescan voltages 906) to respective pixel elements between lines $l_{f2}$ and $l_{f4}$ that are positioned outside the foveal region of the FFOV image.

As shown in FIG. 13, the initial scans 1312 and 1322 are performed at a substantially faster rate than the rescans 1314 and 1324. To facilitate such "fast" scans, the gate driver 914 may be configured to activate multiple lines of the pixel array 910 concurrently. For example, in some embodiments, each transition of the gate clock signals (e.g., included in the set of G_CTRL signals) may cause the gate driver 914 to select a plurality of the gate lines GL(1)-GL(M) for activation. In some aspects, multiple adjacent gate lines may be assigned to a particular gate line group. For example, gate lines GL(1)-GL(4) may be assigned to a first gate line group (GLG1) and gate lines GL(5)-GL(8) may be assigned to a second gate line group (GLG2). In some aspects, the gate driver 914 may successively drive each of the gate lines GL(1)-GL(4) when the first gate line group GLG1 is selected. In some other aspects, the gate driver 914 may drive two or more of the gate lines GL(1)-GL(4), concurrently, when the first gate line group GLG1 is selected.

In some embodiments, the gate driver 914 may be configured to drive the gate lines GL(1)-GL(M) in a hierarchical manner. For example, rather than directly driving a particular gate line in response to each transition of the gate clock signals, the gate driver 914 may instead select a group of gate lines for activation in response to each transition of the gate clock signals. The gate driver 914 may then selectively activate individual gate lines within the selected group. The hierarchical manner in which the gate lines GL(1)-GL(M) are driven allows the gate driver 914 to facilitate fast scans of the pixel array 910 (e.g., when rendering a relatively low-resolution FFOV image) and slower rescans of the pixel array 910 (e.g., when rendering a relatively high-resolution foveal image). Furthermore, the hierarchical manner in which the gate lines GL(1)-GL(M) are driven allows the gate driver 914 to have a smaller footprint than that of existing gate driver circuitry (e.g., since fewer shift register stages are needed to drive an equivalent number of gate lines).

Figure 14:
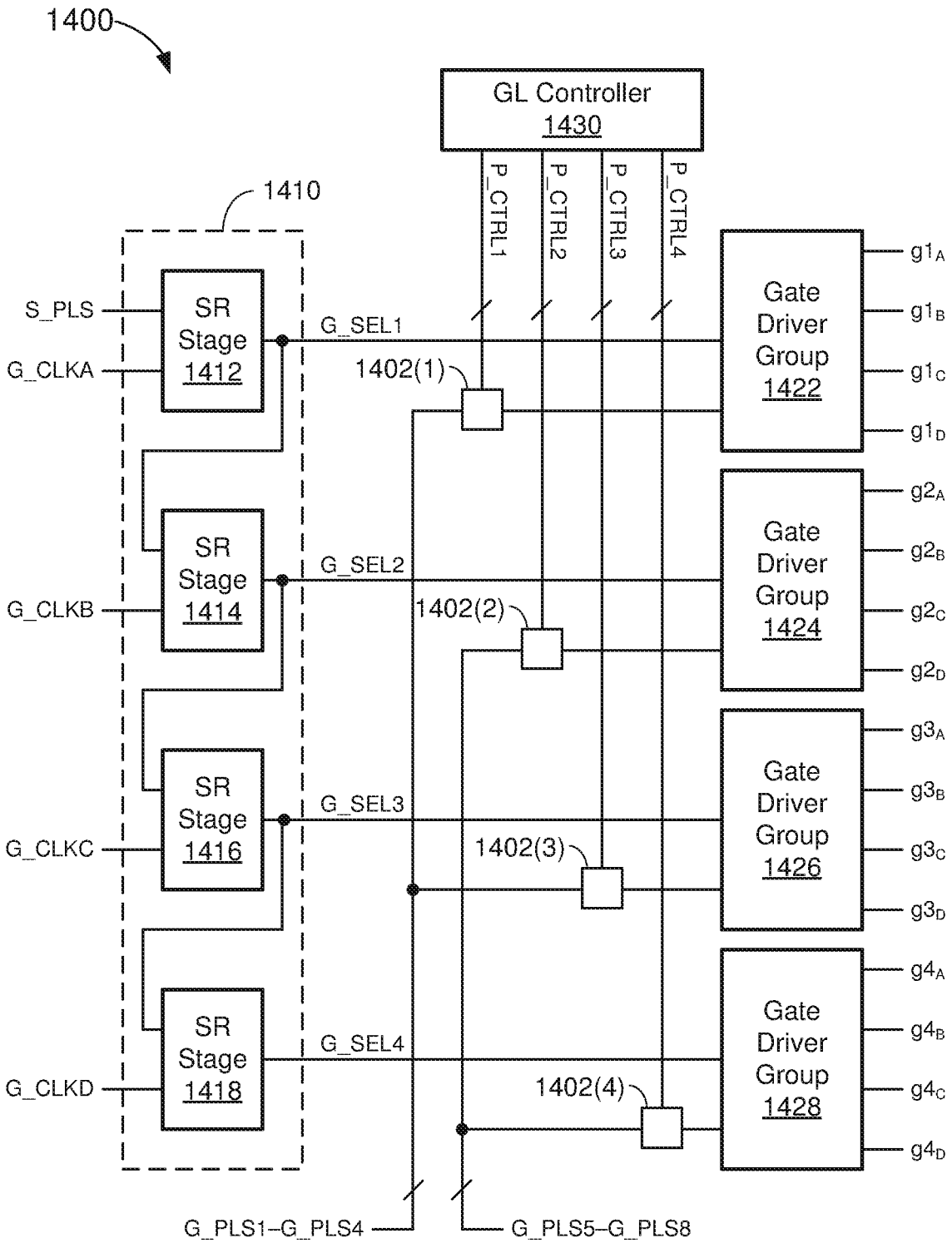
FIG. 14 is a block diagram of a hierarchical gate driver circuit, in accordance with some embodiments.

FIG. 14 is a block diagram of a hierarchical gate driver circuit 1400, in accordance with some embodiments. For example, the hierarchical gate driver circuit 1400 may be an embodiment of the gate driver 914 shown in FIG. 9. The hierarchical gate driver circuit 1400 includes a shift register 1410 and a plurality of gate driver groups 1422-1428. For simplicity, only four gate driver groups 1422-1428 are depicted in the example of FIG. 14. However, in actual implementations, the hierarchical gate driver circuit 1400 may include fewer or more gate driver groups than what is depicted in FIG. 14.

The shift register 1410 may comprise multiple stages 1412-1418. For example, the shift register (SR) stages 1412-1418 may be implemented as a cascade of flip-flops arranged in a serial-in/parallel-out (SIPO) configuration. In some embodiments, the number of SR stages in the shift register 1410 may correspond with the number of gate driver groups in the hierarchical gate driver circuit 1400. Thus, although only four SR stages 1412-1418 are depicted in the example of FIG. 14, actual implementations of the shift register 1410 may include fewer or more stages than what is depicted in FIG. 14. The shift register 1410 is coupled to receive a start pulse (S_PLS) and a plurality of gate clock signals (G_CLKA-G_CLKD). As described above, the start pulse S_PLS may be used to trigger a scan of a pixel array (such as pixel array 910 of FIG. 9) coupled to a plurality of gate lines ($g1_A$-$g4_D$). The gate clock signals G_CLKA-G_CLKD may be used to control activation of the gate lines $g1_A$-$g4_D$ at different times. Thus, the gate clock signals G_CLKA-G_CLKD may each have a different phase offset relative to one another.

The first SR stage 1412 in the cascade is configured to receive S_PLS as its input, and is configured to drive a first group select line (G_SEL1) based on S_PLS and a first gate clock signal (G_CLKA). The input of the second SR stage 1414 is coupled to the output of the first SR stage 1412. Thus, the second SR stage 1414 is configured to drive a second group select line (G_SEL2) based on G_SEL1 and a second gate clock signal (G_CLKB). The input of the third SR stage 1416 is coupled to the output of the second SR stage 1414. Thus, the third SR stage 1416 is configured to drive a third group select line (G_SEL3) based on G_SEL2 and a third gate clock signal (G_CLKC). The input of the fourth SR stage 1418 is coupled to the output of the third SR stage 1416. Thus, the fourth SR stage 1418 is configured to drive a fourth group select line (G_SEL4) based on G_SEL3 and a fourth gate clock signal (G_CLKD). In some embodiments, the output of the fourth SR stage 1418 may be coupled to the input of a fifth SR stage in the cascade (not shown for simplicity).

The gate driver groups 1422-1428 are coupled to the outputs of the SR stages 1412-1418 via the group select lines G_SEL1-G_SEL4, respectively. Each of the gate driver groups 1422-1428 is configured to selectively drive a group of gate lines (g1-g4) when a corresponding group select line is activated. More specifically, the group select lines G_SEL1-G_SEL4 may enable the respective gate driver groups 1422-1428 to drive a corresponding group of gate lines. For example, activation of the first group select line G_SEL1 enables the first gate driver group 1422 to drive a first group of gate lines $g1_A$-$g1_D$. Activation of the second group select line G_SEL2 enables the second gate driver group 1424 to drive a second group of gate lines $g2_A$-$g2_D$. Activation of the third group select line G_SEL3 enables the third gate driver group 1426 to drive a third group of gate lines $g3_A$-$g3_D$. Activation of the fourth group select line G_SEL4 enables the fourth gate driver group 1428 to drive a fourth group of gate lines $g4_A$-$g4_D$.

In some embodiments, the gate driver groups 1422-1428 may drive the gate lines $g1_A$-$g4_D$ based at least in part on a series of gate pulses G_PLS1-G_PLS8. More specifically, the gate pulses G_PLS1-G_PLS8 may control a timing with which the gate driver groups 1422-1428 drives the gate lines $g1_A$-$g4_D$. For example, gate pulses G_PLS1-G_PLS4 may be provided to the first gate driver group 1422 and the third gate driver group 1426, whereas gate pulses G_PLS5-G_PLS8 may be provided to the second gate driver group 1424 and the fourth gate driver group 1428. Thus, the first gate driver group 1422 may drive the first group of gate lines $g1_A$-$g1_D$ based on gate pulses G_PLS1-G_PLS4. The second gate driver group 1424 may drive the second group of gate lines $g2_A$-$g2_D$ based on gate pulses G_PLS5-G_PLS8. The third gate driver group 1426 may drive the third group of gate lines $g3_A$-$g3_D$ based on gate pulses G_PLS1-G_PLS4. The fourth gate driver group 1428 may drive the fourth group of gate lines $g4_A$-$g4_D$ based on gate pulses G_PLS5-G_PLS8.

Figure 15A:
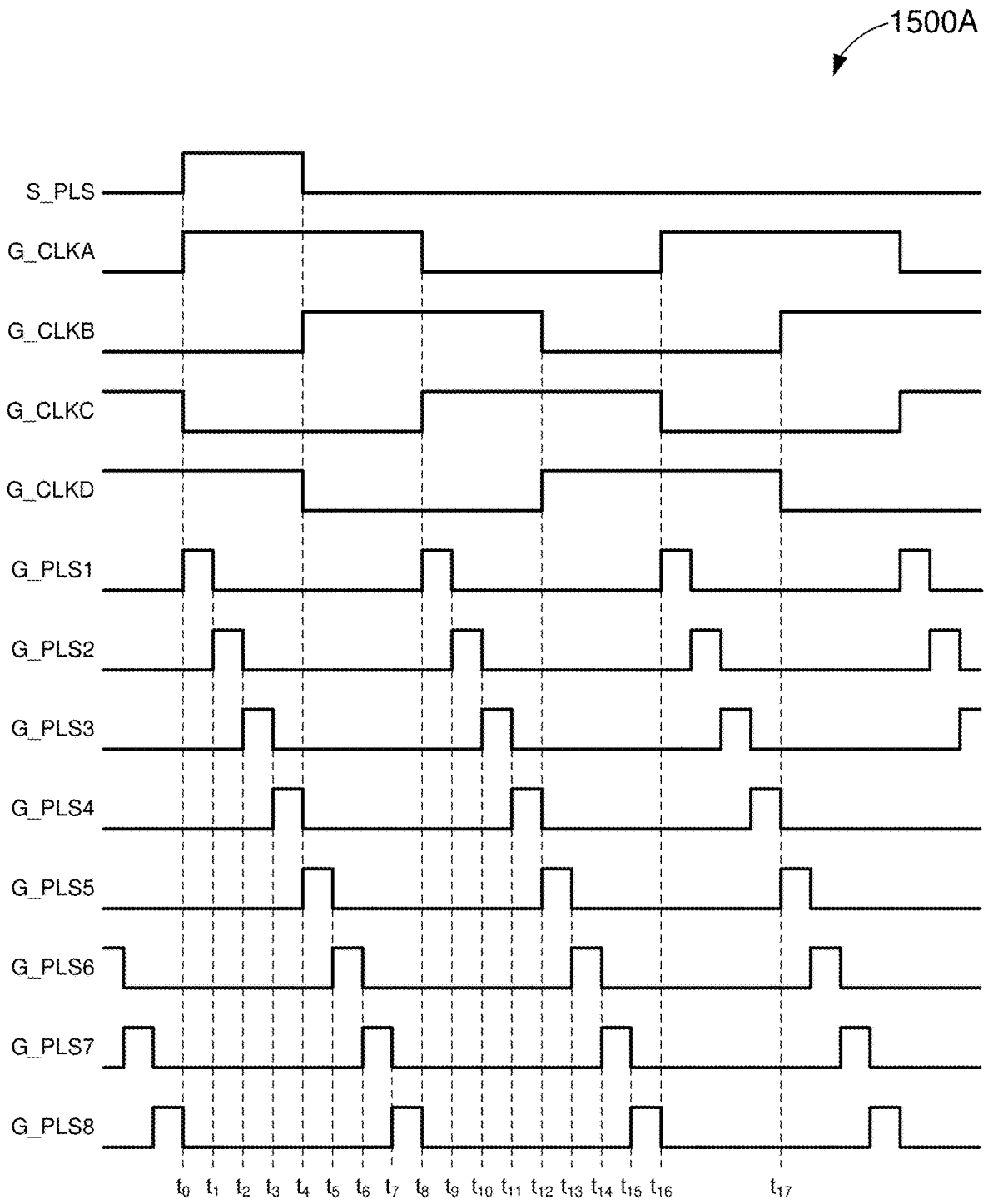
FIGS. 15A and 15B are timing diagrams depicting example timing signals that may be used to control an operation of a hierarchical gate driver circuit, in accordance with some embodiments.
Figure 15B:
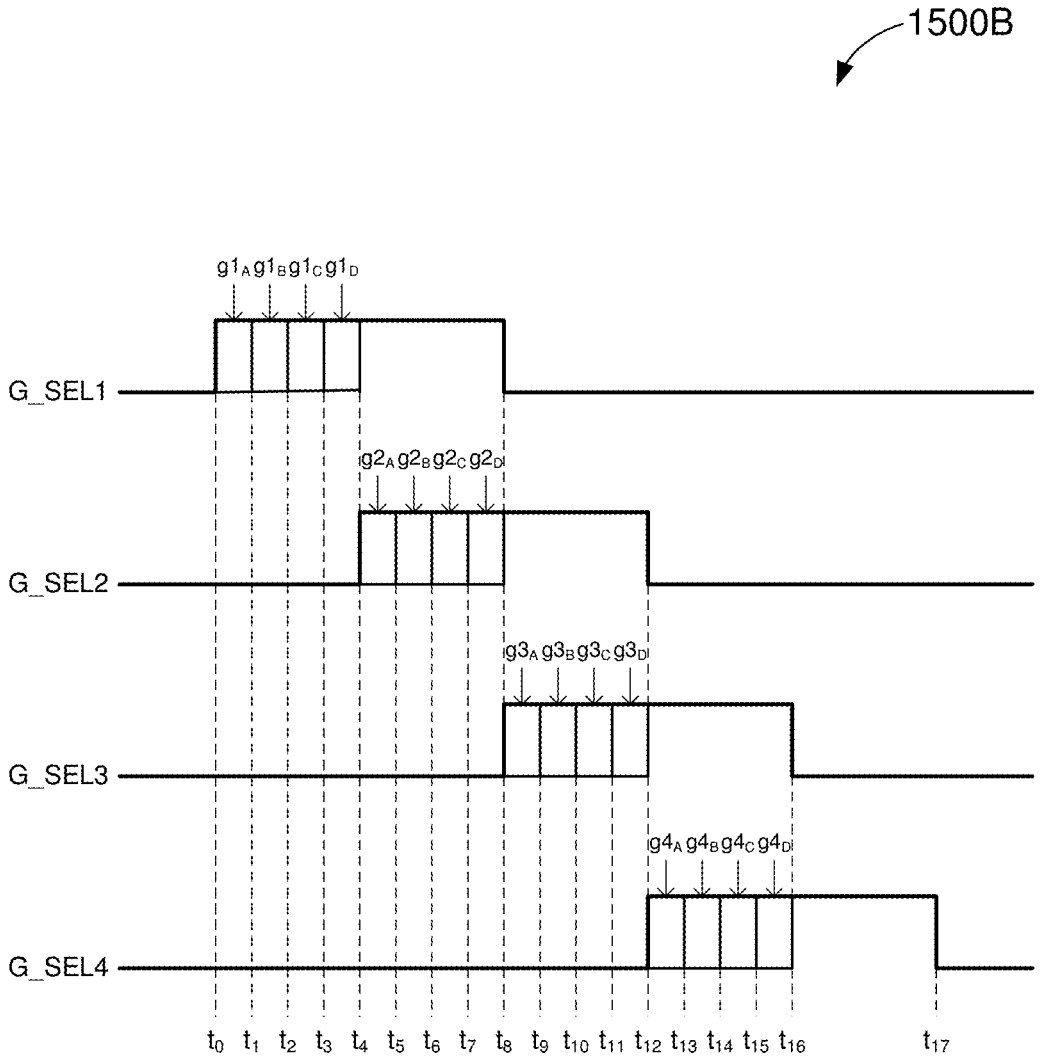

FIGS. 15A and 15B are timing diagrams 1500A and 1500B, respectively, depicting example timing signals that may be used to control operation of a hierarchical gate driver circuit. With reference for example to FIG. 14, the timing signals depicted in FIGS. 15A and 15B may control an operation of the hierarchical gate driver circuit 1400.

At time $t_0$, the start pulse S_PLS is asserted and the first gate clock signal G_CLKA transitions to a logic high state.

The rising-edge transition of G_CLKA causes the first SR stage 1412 to shift-in (e.g., store) the current state of S_PLS. Since S_PLS is currently asserted to a logic high state, at time to, the first SR stage 1412 also drives the first group select line G_SEL1 to a logic high state. The activation of G_SEL1 enables the first gate driver group 1422 to drive the first group of gate lines $g1_A$-$g1_D$ in response to gate pulses G_PLS1-G_PLS4.

The first gate driver group 1422 may drive gate line $g1_A$, at time $t_0$, for the duration in which G_SEL1 and G_PLS1 are concurrently asserted (e.g., from times $t_0$ to $t_1$). The first gate driver group 1422 may drive gate line $g1_B$, at time $t_1$, for the duration in which G_SEL1 and G_PLS2 are concurrently asserted (e.g., from times $t_1$ to $t_2$). The first gate driver group 1422 may drive gate line $g1_C$, at time $t_2$, for the duration in which G_SEL1 and G_PLS3 are concurrently asserted (e.g., from times $t_2$ to $t_3$). The first gate drive group 1422 may drive gate line $g1_D$, at time $t_3$, for the duration in which G_SEL1 and G_PLS4 are concurrently asserted (e.g., from times $t_3$ to $t_4$).

At time $t_4$, the start pulse S_PLS is deasserted and the second gate clock signal G_CLKB transitions to a logic high state. The rising-edge transition of G_CLKB causes the second SR stage 1414 to shift-in the current state of G_SEL1. Since G_SEL1 is currently asserted to a logic high state, at time $t_4$, the second SR stage 1414 also drives the second group select line G_SEL2 to a logic high state. The activation of G_SEL2 enables the second gate driver group 1424 to drive the second group of gate lines $g2_A$-$g2_D$ in response to gate pulses G_PLS5-G_PLS8.

The second gate driver group 1424 may drive gate line $g2_A$, at time $t_4$, for the duration in which G_SEL2 and G_PLS5 are concurrently asserted (e.g., from times $t_4$ to $t_5$). The second gate driver group 1424 may drive gate line $g2_B$, at time $t_5$, for the duration in which G_SEL2 and G_PLS6 are concurrently asserted (e.g., from times $t_5$ to $t_6$). The second gate driver group 1424 may drive gate line $g2_C$, at time $t_6$, for the duration in which G_SEL2 and G_PLS7 are concurrently asserted (e.g., from times $t_6$ to $t_7$). The second gate driver group 1424 may drive gate line $g2_D$, at time $t_7$, for the duration in which G_SEL2 and G_PLS8 are concurrently asserted (e.g., from times $t_7$ to $t_8$).

At time $t_8$, the first gate clock signal G_CLKA transitions to a logic low state while the third gate clock signal G_CLKC transitions to a logic high state. The falling-edge transition of G_CLKA causes the first SR stage 1412 to shift-in the current state of S_PLS. Since S_PLS is currently deasserted to a logic low state, at time $t_8$, the first SR stage 1412 also pulls G_SEL1 to a logic low state. The deactivation of G_SEL1 disables the first gate driver group 1422, thus preventing activation of any of the first group of gate lines $g1_A$-$g1_D$.

The rising-edge transition of G_CLKC causes the third SR stage 1416 to shift-in the current state of G_SEL2. Since G_SEL2 is currently asserted to a logic high state, at time $t_8$, the third SR stage 1416 also drives the third group select line G_SEL3 to a logic high state. The activation of G_SEL3 enables the third gate driver group 1426 to drive the third group of gate lines $g3_A$-$g3_D$ in response to gate pulses G_PLS1-G_PLS4.

The third gate driver group 1426 may drive gate line $g3_A$, at time $t_8$, for the duration in which G_SEL3 and G_PLS1 are concurrently asserted (e.g., from times $t_8$ to $t_9$). The third gate driver group 1426 may drive gate line $g3_B$, at time $t_9$, for the duration in which G_SEL3 and G_PLS2 are concurrently asserted (e.g., from times $t_9$ to $t_{10}$). The third gate driver group 1426 may drive gate line $g3_C$, at time $t_{10}$, for the duration in which G_SEL3 and G_PLS3 are concurrently asserted (e.g., from times $t_{10}$ to $t_{11}$). The third gate driver group 1426 may drive gate line $g3_D$, at time $t_{11}$, for the duration in which G_SEL3 and G_PLS4 are concurrently asserted (e.g., from times $t_{11}$ to $t_{12}$).

At time $t_{12}$, the second gate clock signal G_CLKB transitions to a logic low state while the fourth gate clock signal G_CLKD transitions to a logic high state. The falling-edge transition of G_CLKB causes the second SR stage 1414 to shift-in the current state of G_SEL1. Since G_SEL1 is currently deasserted to a logic low state, at time $t_{12}$, the second SR stage 1414 also pulls G_SEL2 to a logic low state. The deactivation of G_SEL2 disables the second gate driver group 1424, thus preventing activation of any of the second group of gate lines $g2_A$-$g2_D$.

The rising-edge transition of G_CLKD causes the fourth SR stage 1418 to shift-in the current state of G_SEL3. Since G_SEL3 is currently asserted to a logic high state, at time $t_{12}$, the fourth SR stage 1418 also drives the fourth group select line G_SEL4 to a logic high state. The activation of G_SEL4 enables the fourth gate driver group 1428 to drive the fourth group of gate lines $g4_A$-$g4_D$ in response to gate pulses G_PLS5-G_PLS8.

The fourth gate driver group 1428 may drive gate line $g4_A$, at time $t_{12}$, for the duration in which G_SEL4 and G_PLS5 are concurrently asserted (e.g., from times $t_{12}$ to $t_{13}$). The fourth gate driver group 1428 may drive gate line $g4_B$, at time $t_{13}$, for the duration in which G_SEL4 and G_PLS6 are concurrently asserted (e.g., from times $t_{13}$ to $t_{14}$). The fourth gate driver group 1428 may drive gate line $g4_C$, at time $t_{14}$, for the duration in which G_SEL4 and G_PLS7 are concurrently asserted (e.g., from times $t_{14}$ to $t_{15}$). The fourth gate driver group 1428 may drive gate line $g4_D$, at time $t_{15}$, for the duration in which G_SEL4 and G_PLS8 are concurrently asserted (e.g., from times $t_{15}$ to $t_{16}$).

At time $t_{16}$, the third gate clock signal G_CLKC transitions to a logic low state while the first gate clock signal G_CLKA transitions to a logic high state. The falling-edge transition of G_CLKC causes the third SR stage 1416 to shift-in the current state of G_SEL2. Since G_SEL2 is currently deasserted to a logic low state, at time $t_{16}$, the third SR stage 1416 also pulls G_SEL3 to a logic low state. The rising-edge transition of G_CLKA causes the first SR stage 1412 to shift-in the current state of S_PLS. However, since S_PLS is still in a logic low state, at time $t_{16}$, the first SR stage 1412 may continue to hold G_SEL1 in the logic low state.

At time $t_{17}$, the fourth gate clock signal G_CLKD transitions to a logic low state while the second gate clock signal G_CLKB transitions to a logic high state. The falling-edge transition of G_CLKD causes the fourth SR stage 1418 to shift-in the current state of G_SEL3. Since G_SEL3 is currently deasserted to a logic low state, at time $t_{17}$, the fourth SR stage 1418 also pulls G_SEL4 to a logic low state. The rising-edge transition of G_CLKB causes the second SR stage 1414 to shift-in the current state of G_SEL1. However, since G_SEL1 is still in a logic low state, at time $t_{17}$, the second SR stage 1414 may continue to hold G_SEL2 in the logic low state.

In the example of FIG. 15A, the gate clock signals G_CLKA-G_CLKD at least partially overlap one another. For example, G_CLKA remains asserted for at least part of the duration in which G_CLKB is asserted, G_CLKB remains asserted for at least part of the duration in which G_CLKC is asserted, G_CLKC remains asserted for at least part of the duration in which G_CLKD is asserted, and G_CLKD remains asserted for at least part of the duration in which G_CLKA is asserted. However, the gate pulses G_PLS1-G_PLS8 are asserted for such short durations that none of the gate pulses G_PLS1-G_PLS8 overlap. This enables the hierarchical gate driver circuit 1400 to drive multiple gate lines, in succession, during a single clock cycle of a particular gate clock signal. In some embodiments, each of the gate driver groups 1422-1428 may completely pull each gate line to a logic low state before driving the next gate line to a logic high state.

Furthermore, because the outputs of the SR stages 1412-1418 are used to enable the gate driver groups 1422-1428, rather than directly drive a load (e.g., a row of pixel elements), the hierarchical gate driver circuit 1400 may scan the rows of a pixel array with greater speed and flexibility than that of existing gate driver circuits. For example, since the input of the second SR stage 1414 is not tied to any of the first group of gate lines $g1_A$-$g1_D$, the second SR stage 1414 may drive the second group select line G_SEL2 without having to wait for any of the gate lines $g1_A$-$g1_D$ to be driven to a sufficiently high voltage (e.g., $\geq V_{GH}$). This may allow the hierarchical gate driver circuit 1400 to perform a scanning operation with coarser granularity and/or greater precision.

In some embodiments, the hierarchical gate driver circuit 1400 may include a gate line (GL) controller 1430 to control the flow of the gate pulses G_PLS1-G_PLS8 to the gate driver groups 1422-1428. In some aspects, the GL controller 1430 may suppress and/or redirect one or more of the gate pulses G_PLS1-G_PLS8 intended for the gate driver groups 1422-1428. For example, the GL controller 1430 may cause two or more gate driver elements to drive respective gate lines, concurrently, in response to the same gate pulse. In some aspects, the GL controller 1430 may be coupled to a plurality of pulse filters 1402(1)-1402(4). Each of the pulse filters 1402(1)-1402(4) may selectively suppress the gate pulses provided to a respective one of the gate driver groups 1422-1428. The GL controller 1430 may control the pulse filters 1402(1)-1402(4) via a plurality of pulse control signals P_CTRL1-P_CTRL4.

In some embodiments, each of the pulse filters 1402(1)-1402(4) may comprise a set of AND logic gates. For example, the first pulse filter 1402(1) may provide the gate pulses G_PLS1-G_PLS4 to the first gate driver group 1422 only when the first set of pulse control signals P_CTRL1 are asserted. The second pulse filter 1402(2) may provide the gate pulses G_PLS5-G_PLS8 to the second gate driver group 1424 only when the second set of pulse control signals P_CTRL2 are asserted. The third pulse filter 1402(3) may provide the gate pulses G_PLS1-G_PLS4 to the third gate driver group 1426 only when the third set of pulse control signals P_CTRL3 are asserted. The fourth pulse filter 1402(4) may provide the gate pulses G_PLS5-G_PLS8 to the fourth gate driver group 1428 only when the fourth set of pulse control signals P_CTRL4 are asserted.

If one or more of the first set of pulse control signals P_CTRL1 are deasserted, the first pulse filter 1402(1) may suppress a corresponding one or more of the gate pulses G_PLS1-G_PLS4. If one or more of the second set of pulse control signals P_CTRL2 are deasserted, the second pulse filter 1402(2) may suppress a corresponding one or more of the gate pulses G_PLS5-G_PLS8. If one or more of the third set of pulse control signals P_CTRL3 are deasserted, the third pulse filter 1402(3) may suppress a corresponding one or more of the gate pulses G_PLS1-G_PLS4. If one or more of the fourth set of pulse control signals P_CTRL4 are deasserted, the fourth pulse filter 1402(4) may suppress a corresponding one or more of the gate pulse G_PLS5-G_PLS8.

In some other embodiments, the GL controller 1430 may redistribute one or more of the gate pulses G_PLS1-G_PLS8 among the gate driver elements within each of the gate driver groups 1422-1428. For example, the first pulse filter 1402(1) may suppress gate pulses G_PLS2-G_PLS4 from being delivered to the first gate driver group 1422 in response to a first set of P_CTRL1 signals received from the GL controller 1430. In response to a second set of P_CTRL1 signals, the pulse filter 1402(1) may redistribute the first gate pulse G_PLS1 to each of the gate driver elements in the first gate driver group 1422. As a result, each of the gate lines $g1_A$-$g1_D$ coupled to the first gate driver group 1422 may be driven concurrently in response to the same gate pulse (e.g., G_PLS1).

Among other advantages, the hierarchical gate driver circuit 1400 may scan an array of display pixels with greater speed and/or flexibility than existing gate driver circuitry. In some embodiments, the GL controller 1430 may suppress one or more of the gate pulses G_PLS1-G_PLS8 to perform a fast scan of the corresponding pixel array (e.g., to render an FFOV image on the pixel array). In some other embodiments, the GL controller 1430 may only enable one or more of the gate pulses G_PLS1-G_PLS8 for a particular gate driver group to perform a slower rescan of only a subset of rows of the corresponding pixel array (e.g., to render a foveal image on the pixel array).

Figure 16:
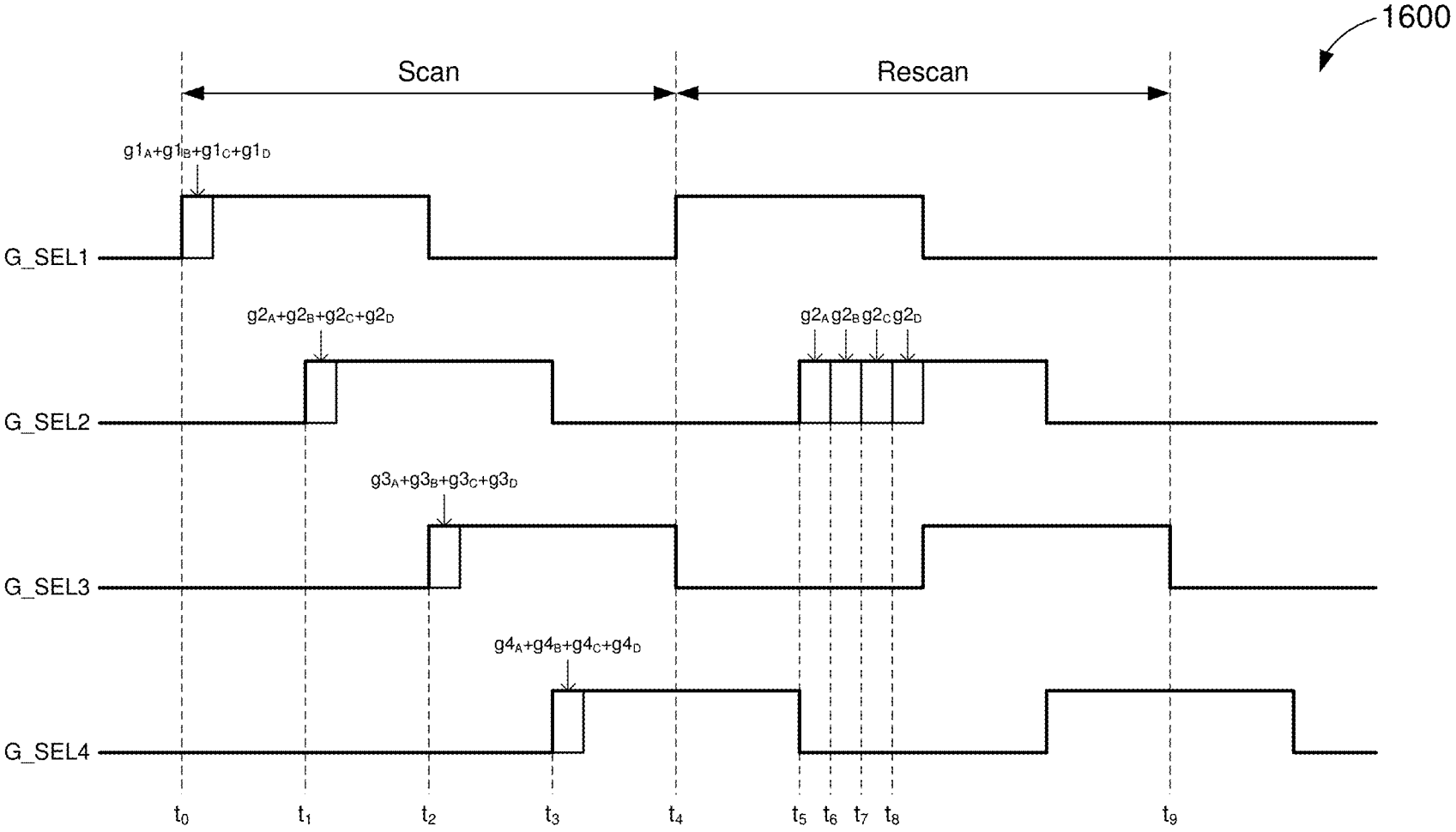
FIG. 16 is a timing diagram depicting an example timing of scan-rescan pixel update operations using a hierarchical gate driver circuit, in accordance with some embodiments.

FIG. 16 is a timing diagram 1600 depicting an example timing of scan-rescan pixel update operations using a hierarchical gate driver circuit, in accordance with some embodiments. With reference for example to FIG. 14, the example operation of FIG. 16 may be performed by the hierarchical gate driver circuit 1400 to render a foveal image within an FFOV image on a pixel array. More specifically, in the example of FIG. 16, an FFOV image may be rendered on the pixel array during an initial scan (e.g., from times $t_0$ to $t_4$) and a foveal image may be rendered on the pixel array during a subsequent rescan (e.g., from times $t_4$ to $t_9$).

At time $t_0$, the first group select line G_SEL1 is driven to a logic high state. Activation of G_SEL1 enables the first gate driver group 1422 to drive the first group of gate lines $g1_A$-$g1_D$ in response to gate pulses G_PLS1-G_PLS4. In the example of FIG. 16, the GL controller 1430 may suppress the gate pulses G_PLS2-G_PLS4, allowing only the gate pulse G_PLS1 to be supplied to the first gate driver group 1422. Accordingly, the first gate driver group 1422 may drive gate lines $g1_A$-$g1_D$, concurrently, in response to the gate pulse G_PLS5. As a result, the voltages (e.g., scan voltages 905) on the data lines (e.g., DL(1)-DL(N)) may be driven onto respective pixel elements coupled to each of the gate lines $g1_A$-$g1_D$, concurrently, at time $t_0$.

At time $t_1$, the second group select line G_SEL2 is driven to a logic high state. Activation of G_SEL2 enables the second gate driver group 1424 to drive the second group of gate lines $g2_A$-$g2_D$ in response to gate pulses G_PLS5-G_PLS8. In the example of FIG. 16, the GL controller 1430 may suppress the gate pulses G_PLS6-G_PLS8, allowing only the gate pulse G_PLS5 to be supplied to the second gate driver group 1424. Accordingly, the second gate driver group 1424 may drive gate lines $g2_A$-$g2_D$, concurrently, in response to the gate pulse G_PLS5. As a result, the voltages (e.g., scan voltages 905) on the data lines may be driven onto respective pixel elements coupled to each of the gate lines $g2_A$-$g2_D$, concurrently, at time $t_1$.

At time $t_2$, the third group select line G_SEL3 is driven to a logic high state. Activation of G_SEL3 enables the third gate driver group 1426 to drive the third group of gate lines $g3_A$-$g3_D$ in response to gate pulses G_PLS1-G_PLS4. In the example of FIG. 16, the GL controller 1430 may suppress the gate pulses G_PLS2-G_PLS4, allowing only the gate pulse G_PLS1 to be supplied to the third gate driver group 1426. Accordingly, the third gate driver group 1426 may drive gate lines $g3_A$-$g3_D$, concurrently, in response to the gate pulse G_PLS1. As a result, the voltages (e.g., scan voltages 905) on the data lines may be driven onto respective pixel elements coupled to each of the gate lines $g3_A$-$g3_D$, concurrently, at time $t_2$.

At time $t_3$, the fourth group select line G_SEL4 is driven to a logic high state. Activation of G_SEL4 enables the fourth gate driver group 1428 to drive the fourth group of gate lines $g4_A$-$g4_D$ in response to gate pulses G_PLS5-G_PLS8. In the example of FIG. 16, the GL controller 1430 may suppress the gate pulses G_PLS6-G_PLS8, allowing only the gate pulse G_PLS5 to be supplied to the fourth gate driver group 1428. Accordingly, the fourth gate driver group 1428 may drive gate lines $g4_A$-$g4_D$, concurrently, in response to the gate pulse G_PLS5. As a result, the voltages (e.g., scan voltages 905) on the data lines may be driven onto respective pixel elements coupled to each of the gate lines $g4_A$-$g4_D$, concurrently, at time $t_3$.

A rescan of the pixel array is triggered at time $t_4$ (e.g., in response to another start pulse S_PLS). In the example of FIG. 16, the foveal region of the FFOV image may coincide with gate lines $g2_A$-$g2_D$. Since the display device may rescan only the foveal region when rendering the foveal image (e.g., from times $t_4$ to $t_9$), the GL controller 1430 may suppress the gate pulses G_PLS1-G_PLS4 from being supplied to the first gate driver group 1422 and the third gate driver group 1426. The GL controller 1430 may also suppress the gate pulses G_PLS5-G_PLS8 from being supplied to the fourth gate driver group 1428. However, the GL controller 1430 may enable each of the gate pulses G_PLS1-G_PLS4 to be supplied to the second gate driver group 1424 (e.g., which controls activation of the gate lines $g2_A$-$g2_D$).

Thus, at time $t_5$, activation of the second gate select line G_SEL2 in combination with the gate pulse G_PLS5 causes the second gate driver group 1424 to activate gate line $g2_A$. At time $t_6$, activation of the second gate select line G_SEL2 in combination with the gate pulse G_PLS6 causes the second gate driver group 1424 to activate gate line $g2_B$. At time $t_7$, activation of the second gate select line G_SEL2 in combination with the gate pulse G_PLS7 causes the second gate driver group 1424 to activate gate line $g2_C$. At time $t_8$, activation of the second gate select line G_SEL2 in combination with the gate pulse G_PLS8 causes the second gate driver group 1424 to activate gate line $g2_D$.

It is noted that, because multiple rows of pixel elements are driven with data in response to each of the gate pulses G_PLS1 and G_PLS5, the amount of time need to advance the scan past individual rows of pixel elements initial scan is effectively reduced. This allows the initial scan (e.g., from times to to $t_4$) may be performed at a relatively fast rate. Moreover, because the group select lines G_SEL1, G_SEL3, and G_SEL4 do not drive a load, the rescan (e.g., from times $t_4$ to $t_9$) may be completed soon after the initial scan. For example, because the first group select line G_SEL1 does not drive a load, the second SR stage 1414 may activate the second group select line G_SEL2 almost immediately after the first group select line G_SEL1 is activated. As a result, the pixel elements coupled to gate lines $g2_A$-$g2_D$ may be rescanned (e.g., at time $t_5$) almost immediately after the pixel elements coupled to gate lines $g4_A$-$g4_D$ are scanned (e.g., at time $t_3$).

Figure 17:
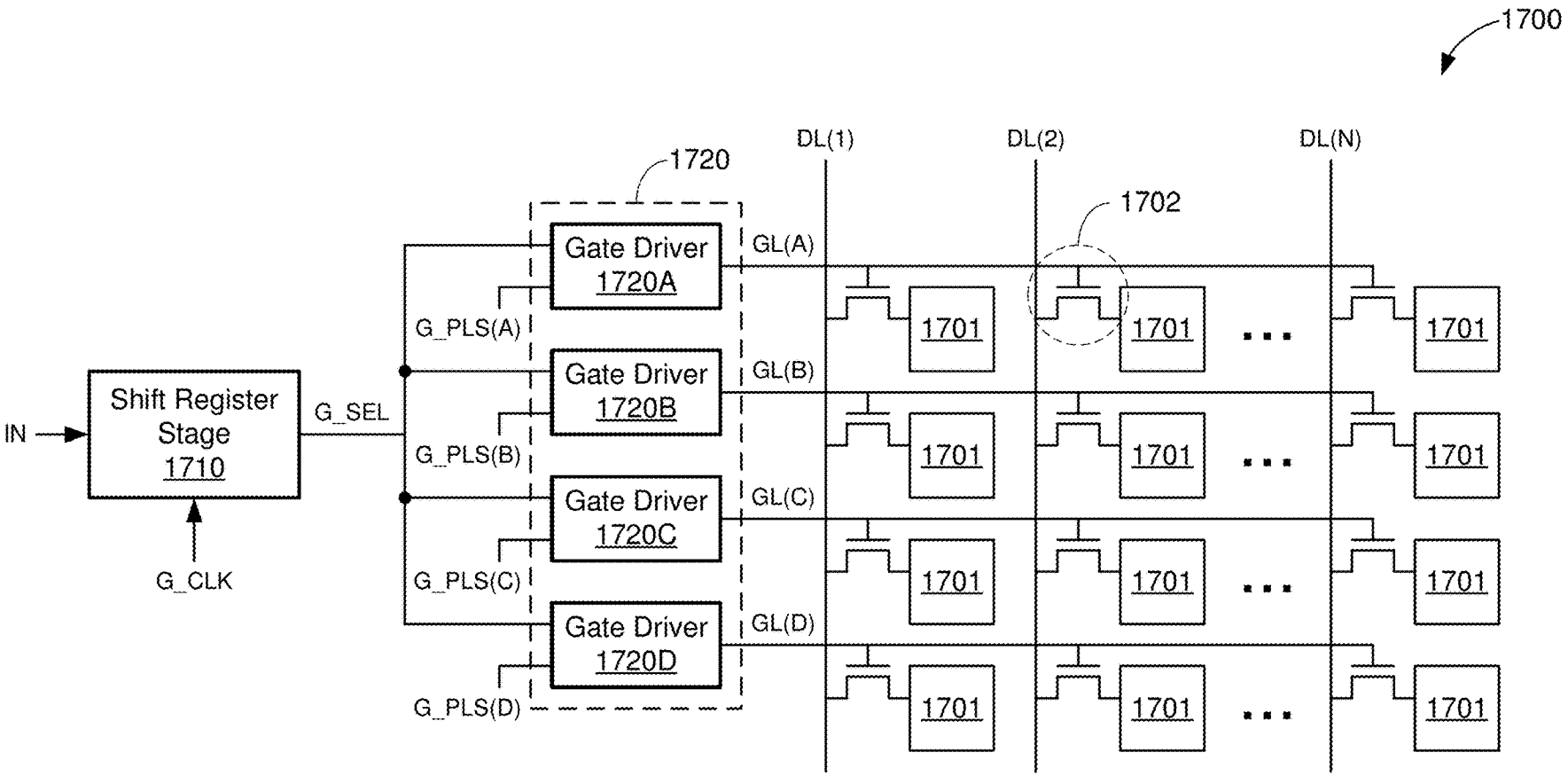
FIG. 17 is a block diagram depicting a portion of a display device, in accordance with some embodiments.

FIG. 17 is a block diagram depicting a portion of a display device 1700, in accordance with some embodiments. The display device 1700 may be an example embodiment of the display device 900 of FIG. 9. The display device 1700 includes a shift register stage 1710, a gate driver group 1720, and a plurality of pixel elements 1701. For example, the pixel elements 1701 may comprise at least a portion of the pixel array 910 of FIG. 9. The shift register stage 1710 and gate driver group 1720 may comprise at least a portion of the gate driver 914 and/or the hierarchical gate driver circuit 1400 of FIG. 14. In the example of FIG. 17, only one shift register stage 1710 and one gate driver group 1720 is shown for simplicity. However, in actual implementations, the display device 1700 may include fewer or more shift register stages and/or gate driver groups than what is depicted in FIG. 17.

The pixel elements 1701 may comprise display pixels (e.g., liquid crystal capacitors), photodiodes (e.g., for image sensing), sensor electrodes (e.g., for capacitive sensing), or any combination thereof. In the example of FIG. 17, the pixel elements 1701 are arranged in rows and columns. Each row of pixel elements 1701 is coupled to a respective gate line (GL) and each column of pixel elements 1701 is coupled to a respective data line (DL). More specifically, each pixel element 1701 is coupled to one of the gate lines GL(A)-GL(D) and one of the data lines DL(1)-DL(N) via an access transistor 1702. In the example of FIG. 17, the access transistor 1702 is an NMOS transistor having a gate terminal coupled to a corresponding gate line and a drain terminal coupled to a corresponding data line. The pixel element 1701 is coupled to the source terminal of the access transistor 1702.

In some embodiments, the shift register stage 1710 and gate driver group 1720 may control activation of the gate lines GL(A)-GL(D) in a hierarchical manner. For example, the shift register stage 1710 may drive a group select line (G_SEL) based at least in part on an input signal (IN) and a corresponding gate clock signal (G_CLK). As described above with respect to FIG. 14, the input signal IN may correspond to a start pulse (e.g., if the shift register stage 1710 corresponds to the first stage in a cascade) or the output of a previous shift register stage in the cascade. The shift register stage 1710 may drive the group select line G_SEL when the input signal IN is asserted to a logic high state and the gate clock signal G_CLK also transitions to a logic high state. Activation of the group select line G_SEL enables the gate driver group 1720 to drive the individual gate lines GL(A)-GL(D).

In some embodiments, the gate driver group 1720 may comprise a plurality of gate driver elements 1720A-1720D. Each of the gate driver elements 1720A-1720D may be configured to drive a respective one of the gate lines GL(A)-GL(D) when the group select line G_SEL is activated. In some aspects, the gate driver elements 1720A-1720D may drive the gate lines GL(A)-GL(D) based on a plurality of gate pulses (G_PLS(A)-G_PLS(D)). For example, the first gate driver element 1720A may drive a relatively high gate voltage (e.g., $\geq V_{GH}$) onto the first gate line GL(A) for the duration in which G_SEL and G_PLS(A) are concurrently asserted to a logic high state. Activation of the first gate line GL(A) turns on the access transistors 1702 for the first row of pixel elements 1701, thus allowing pixel data to be driven onto the first row of pixel elements 1701 (e.g., coupled to GL(A)) via the data lines DL(1)-DL(N).

The second gate driver element 1720B may drive a relatively high gate voltage (e.g., $\geq V_{GH}$) onto the second gate line GL(B) for the duration in which G_SEL and G_PLS(B) are concurrently asserted to a logic high state. Activation of the second gate line GL(B) turns on the access transistors 1702 for the second row of pixel elements 1701, thus allowing pixel data to be driven onto the second row of pixel elements 1701 (e.g., coupled to GL(B)) via the data lines DL(1)-DL(N). In some aspects (e.g., as described with respect to the timing diagram of FIG. 15A), the first gate pulse G_PLS(A) may be deasserted to a logic low state before the second gate pulse G_PLS(B) is asserted to a logic high state. Thus, the first gate driver element 1720A may deactivate the first gate line GL(A) (e.g., by pulling the gate voltage $\leq V_{GL}$) before the second gate line GL(B) is activated.

The third gate driver element 1720C may drive a relatively high gate voltage (e.g., $\geq V_{GH}$) onto the third gate line GL(C) for the duration in which G_SEL and G_PLS(C) are concurrently asserted to a logic high state. Activation of the third gate line GL(C) turns on the access transistors 1702 for the third row of pixel elements 1701, thus allowing pixel data to be driven onto the third row of pixel elements 1701 (e.g., coupled to GL(C)). In some aspects, the second gate pulse G_PLS(B) may be deasserted to a logic low state before the third gate pulse G_PLS(C) is asserted to a logic high state. Thus, the second gate driver element 1720B may deactivate the second gate line GL(B) (e.g., by pulling the gate voltage $\leq V_{GL}$) before the third gate line GL(C) is activated.

The fourth gate driver element 1720D may drive a relatively high gate voltage (e.g., $\geq V_{GH}$) onto the fourth gate line GL(D) for the duration in which G_SEL and G_PLS(D) are concurrently asserted to a logic high state. Activation of the fourth gate line GL(D) turns on the access transistors 1702 for the fourth row of pixel elements 1701, thus allowing pixel data to be driven onto the fourth row of pixel elements 1701 (e.g., coupled to GL(D)). In some aspects, the third gate pulse G_PLS(C) may be deasserted to a logic low state before the fourth gate pulse G_PLS(D) is asserted to a logic high state. Thus, the third gate driver element 1720C may deactivate the third gate line GL(C) (e.g., by pulling the gate voltage $\leq V_{GL}$) before the fourth gate line GL(D) is activated.

It is noted that, in order to drive each row of pixel elements 1701 in quick succession (e.g., within half the duration that G_CLK is asserted), the gate driver elements 1720A-1720D should allow the full voltage swing of the gate pulses G_PLS(A)-G_PLS(D) to be driven onto the gate lines GL(A)-GL(D). However, the voltage on the group select line G_SEL may power each of the gate driver elements 1720A-1720D in driving the corresponding gate lines GL(A)-GL(D). Thus, the voltage on the group select line G_SEL may limit the amount of "turn-on" voltage that may be used to drive the gate lines GL(A)-GL(D). In some embodiments, each of the gate driver elements 1720A-1720D may be configured to "boost" the voltage on the group select line G_SEL to allow the full voltage swing of the gate pulses G_PLS(A)-G_PLS(D) to be driven onto the gate lines GL(A)-GL(D). In some aspects, one or more of the gate driver elements 1720A-1720D may comprise a complementary MOS (CMOS) inverter. In other aspects, one or more of the gate driver elements 1720A-1720D may comprise a boosted NMOS driver or a boosted PMOS driver.

Figure 18:
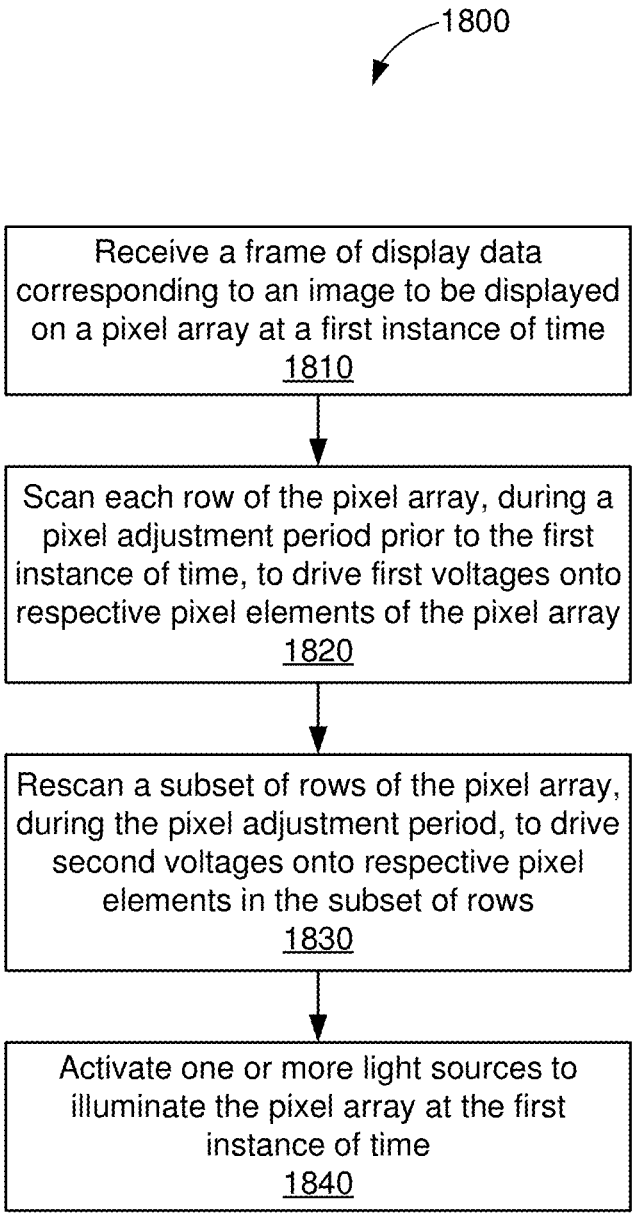
FIG. 18 is an illustrative flowchart depicting an example scan-rescan pixel update operation, in accordance with some embodiments.

FIG. 18 is an illustrative flowchart depicting an example scan-rescan pixel update operation 1800, in accordance with some embodiments. The example operation 1800 may be performed by any display device of the present disclosure including, for example, display devices 120, 300, 500, or 900 of FIGS. 1, 3, 5, and 9. With reference for example to FIG. 3, the example operation 1800 may be performed by the display device 300 to scan a pixel array multiple times during a single frame update period.

The display device may receive a frame of display data corresponding to an image to be displayed on a pixel array at a first instance of time (1810). For example, the display data may include pixel values (e.g., corresponding to a color and/or intensity) for one or more pixel element in the array 310. Each pixel value may be associated with a target voltage level. The target voltage may be a voltage which, when applied to a particular pixel element, causes the color and/or brightness of the pixel element to settle to the desired pixel value.

The display device scans each row of the pixel array, during a pixel adjustment period prior to the first instance of time, to drive first voltages onto respective pixel elements of the pixel array (1820). For example, the display update controller 340 may determine pixel voltages to be applied to one or more pixel elements in the array based, at least in part, on the pixel values. In some embodiments the first voltages may include overdrive voltages to be applied to respective pixel elements in one or more rows of the pixel array (e.g., as described above with respect to FIGS. 5-8). In some other embodiments, the first voltages may include FFOV voltages to be applied to respective pixel elements in each row of the pixel array (e.g., as described above with respect to FIGS. 9-13).

The display device further rescans a subset of rows of the pixel array, during the pixel adjustment period, to drive second voltages onto respective pixel elements in the subset of rows (1830). For example, during a subsequent rescan of the pixel array, the display update controller 340 may determine adjusted pixel voltages to be applied to respective pixel elements in one or more rows of the pixel array. In some embodiments, the second voltages may include target voltages to be applied to respective overdriven pixel elements of the pixel array (e.g., as described above with respect to FIGS. 5-8). In some other embodiments, the second voltages may include foveal voltages to be applied to respective pixel elements in one or more rows of the pixel array (e.g., as described above with respect to FIGS. 9-13).

The display device may then activate one or more light sources to illuminate the pixel array at the first instance of time (1840). For example, each pixel element of the pixel array may begin to transition towards a respective pixel value once the first voltage is applied. The second voltage may alter the state and/or rate of transition of respective pixel elements in the pixel array. However, because the pixel elements are illuminated only during the display periods, any changes in pixel value exhibited before or after the display period will not be seen by the user.

Figure 19:
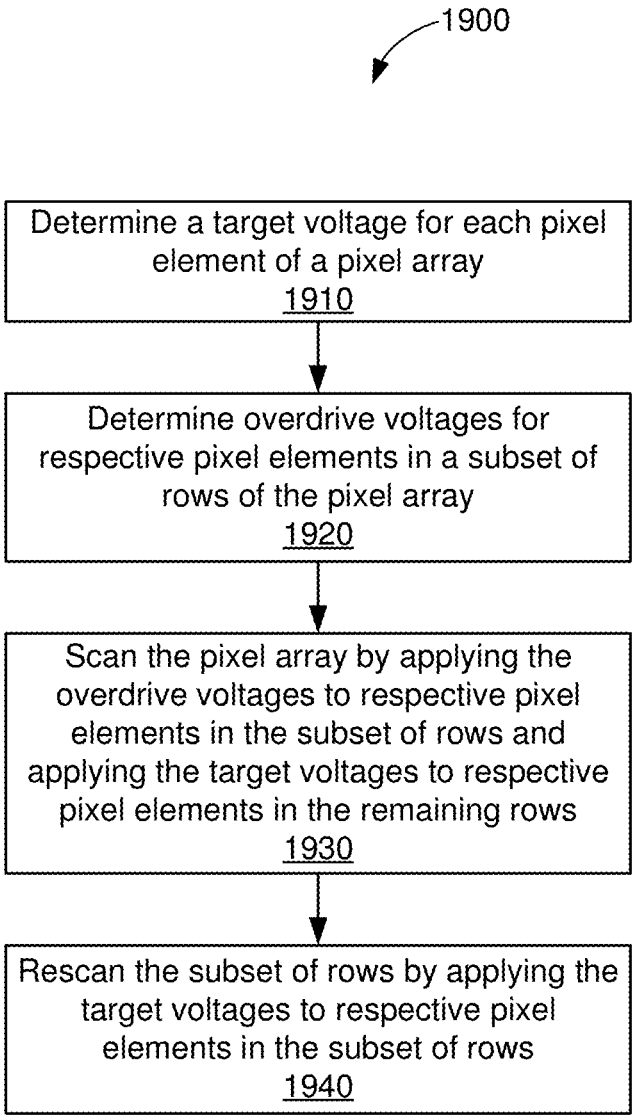
FIG. 19 is an illustrative flowchart depicting an example overdrive correction operation, in accordance with some embodiments.

FIG. 19 is an illustrative flowchart depicting an example overdrive correction operation 1900, in accordance with some embodiments. With reference for example to FIG. 5, the example operation 1900 may be performed by the display device 500 to correct the pixel values for one or more overdriven pixel elements of the pixel array 510.

The display device may determine a target voltage for each pixel element of a pixel array (1910). For example, the overdrive circuitry 530 may determine pixel voltages to be applied to each of the pixel elements in the pixel array based, at least in part, on current pixel values and target pixel values for each pixel element in the array. More specifically, for each pixel element of the array, the overdrive circuitry 530 may compare the current pixel value (e.g., the pixel value from a previous frame update) to the target pixel value (e.g., the pixel value for the next frame update) to determine the amount of voltage to be applied to the pixel element to effect the desired change in pixel value within a frame update period. The target voltage for a particular pixel element causes the pixel element to settle at its target pixel value.

The display device may further determine overdrive voltages for respective pixel elements in a subset of rows of the pixel array (1920). As described above, the overdrive circuitry 530 may determine pixel voltages to be applied to teach of the pixel elements in the pixel array based, at least in part, on current pixel values and target pixel values for each pixel element in the array. It is noted however that if the change in pixel value exceeds a threshold amount, the target voltage may be insufficient to drive the pixel element to the desired pixel value within a given frame update period. Thus, in some embodiments, the overdrive circuitry 530 may determine an overdrive voltage to be applied to one or more pixel elements in the array. As described above, the overdrive voltage may exceed (e.g., may be higher or lower than) the target voltage for a pixel element, thus causing the pixel element to transition (e.g., rotate) faster towards its target pixel value.

The display device may scan the pixel array by applying the overdrive voltages to respective pixel elements in the subset of rows and applying the target voltages to respective pixel elements in the remaining rows (1930). For example, the scan/rescan circuitry 540 may generate scan voltages based on the target voltages and/or the overdrive voltages for respective pixel elements in each row of the pixel array. More specifically, a respective scan voltage may be applied to each pixel element in the pixel array during the initial scan of the array. Thus, the scan voltages may include overdrive voltages for any pixel elements that are unable to settle to their target pixel values by the start of the next display period. In some embodiments, the display device may drive at least some of the pixel elements in the pixel array to their target voltages during the initial scan, while driving only a smaller subset of pixel elements to their overdrive voltages.

The display device may further rescan the subset of rows by applying the target voltages to respective pixel elements in the subset of rows (1940). For example, the scan/rescan circuitry 540 may generate rescan voltages based on the target voltages for any overdriven pixel elements. The rescan voltages may be used to drive each overdriven pixel element (e.g., from the initial scan) to its target voltage. Accordingly, the rescan voltages 506 may include only the target voltages for one or more pixel elements. In some embodiments, the display device may drive only the smaller subset of pixel elements to their target voltages during the rescan. In some other embodiments, the display device may use dithering techniques to hide any unwanted edges that may occur between the initial scan and the rescan.

Figure 20:
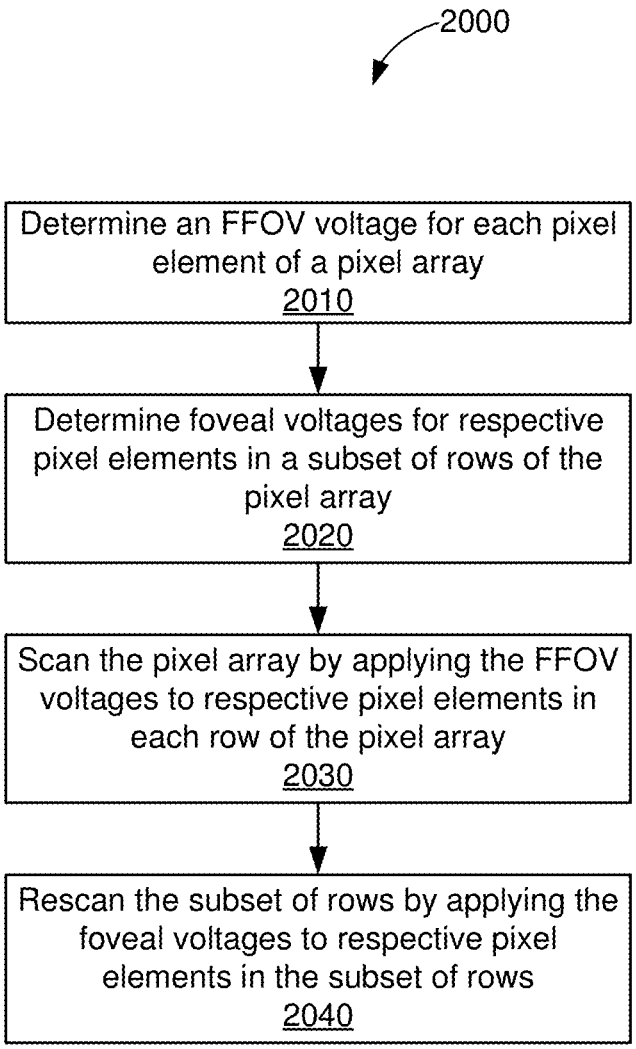
FIG. 20 is an illustrative flowchart depicting an example foveal rendering operation, in accordance with some embodiments.

FIG. 20 is an illustrative flowchart depicting an example foveal rendering operation 2000, in accordance with some embodiments. With reference for example to FIG. 9, the example operation 2000 may be performed by the display device 900 to render an FFOV image, in combination with a foveal image, on the pixel array 910.

The display device may determine an FFOV voltage for each pixel element of a pixel array (2010). For example, the foveal rendering circuitry 930 may determine pixel voltages to be applied to each of the pixel elements in the pixel array based, at least in part, on FFOV pixel values and foveal pixel values from a received frame of display data. The FFOV pixel values may correspond with a full-frame image to be displayed across most (if not all) of the pixel elements of the pixel array. Since the FFOV image may span the periphery of the user's line of sight, the FFOV pixel values may have a relatively low resolution. Thus, in some embodiments, the foveal rendering circuitry 930 may associate each FFOV pixel value with a plurality of FFOV voltages (e.g., to be applied to respective pixel elements of the pixel array).

The display device may further determine foveal voltages for respective pixel elements in a subset of rows of the pixel array (2020). As described above, the foveal rendering circuitry 930 may determine pixel voltages to be applied to each of the pixel elements in the pixel array based, at least in part, on FFOV pixel values and foveal pixel values from a received frame of display data. The foveal pixel values may correspond with a foveal image that spans only the foveal region of the user's line of sight. Since the foveal region may correspond to the region in which the user is determined to have maximal visual acuity, the foveal pixel values may have a relatively high resolution. Thus, in some embodiments, the foveal rendering circuitry 930 may associate each foveal pixel value with a respective foveal voltage (e.g., to be applied to respective pixel elements in a portion of the pixel array).

The display device may scan the pixel array by applying the FFOV voltages to respective pixel elements in each row of the pixel array (2030). For example, the display device may render an FFOV image on the pixel array during an initial scanning operation (e.g., as described above with respect to FIG. 12A). More specifically, the display device may render the FFOV image by scanning each row of the pixel array (e.g., from lines $l_0$ to $l_M$). In some embodiments, the scan/rescan circuitry 940 may generate scan voltages based on the FFOV voltages. For example, a scan voltage may be applied to each pixel element in the pixel array during the initial scan of the array. Thus, each of the scan voltages 905 may correspond to a respective FFOV voltage.

The display device may further rescan the subset of rows by applying the foveal voltages to respective pixel elements in the subset of rows (2040). For example, the display device may render a foveal image on the pixel array, as an overlay of the FFOV image, during a subsequent rescanning operation (e.g., as described above with respect to FIG. 12B). More specifically, the display device may render the foveal image by rescanning only a subset of rows of the pixel array corresponding to a foveal region of the FFOV image (e.g., from lines $l_{f1}$ to $l_{f2}$). In some embodiments, the scan/rescan circuitry 940 may generate rescan voltages based on the foveal voltages. For example, the rescan voltages 906 may be used to drive respective foveal voltages onto each pixel element within a foveal region of the FFOV image displayed on the pixel array. Accordingly, the rescan voltages may include foveal voltages for at least some of the rescanned pixel elements.

During the rescan operation, the scan/rescan circuitry 940 may reapply the FFOV voltages to any pixel elements in the rescanned rows of the pixel array that are outside the foveal region of the FFOV image (such as pixel elements in columns $c_0$ to $c_{f1}$ and $c_{f2}$ to $c_N$ in FIG. 12B). Thus, in some embodiments, the rescan voltages may also include FFOV voltages for at least some of the rescanned pixel elements. Still further, in some embodiments, the display device may use dithering techniques to hide any unwanted edges that may occur between an initial scan and a rescan.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The methods, sequences or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

In the foregoing specification, embodiments have been described with reference to specific examples thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. A method, comprising:

receiving a frame of display data corresponding to an image to be displayed on a pixel array at a first instance of time, the pixel array including a plurality of pixel elements arranged in rows and columns;

determining a plurality of target pixel values for the plurality of pixel elements, respectively, based on the received frame;

for each pixel element in the pixel array, determining a target voltage that causes the pixel element to settle at its target pixel value;

selecting at least some of the pixel elements to receive overdrive voltages based on each of the selected pixel elements having at least a threshold change in pixel value between a current pixel value and its target pixel value, wherein the overdrive voltage for a pixel element is different than the target voltage for that pixel element;

scanning each row of the pixel array, during a pixel adjustment period prior to the first instance of time, to drive a plurality of first voltages onto the plurality of pixel elements, respectively, based on the received frame;

rescanning at least a subset of rows of the pixel array, during the pixel adjustment period, to drive second voltages onto respective pixel elements in the subset of rows based on the received frame, wherein the subset of rows to be rescanned is selected based at least in part on the pixel elements selected to receive overdrive voltages; and activating one or more light sources to illuminate the pixel array at the first instance of time.

2. The method of claim 1, wherein the one or more light sources are deactivated during the pixel adjustment period.

3. The method of claim 1, wherein the scanning comprises:

driving the overdrive voltages onto respective pixel elements in the subset of rows of the pixel array; and driving the target voltages onto respective pixel elements in each of the remaining rows of the pixel array.

4. The method of claim 1, wherein the rescanning comprises:

driving the target voltages onto respective pixel elements in the subset of rows of the pixel array.

5. The method of claim 1, wherein the image includes a full field-of-view (FFOV) image and a foveal image positioned within the FFOV image, the method further comprising:

for each pixel of the FFOV image, selecting a plurality of pixel elements of the pixel array to display the pixel of the FFOV image;

for each pixel of the foveal image, selecting a respective pixel element of the pixel array to display the pixel of the foveal image; and selecting the subset of rows based at least in part on the pixel elements selected to display the foveal image.

6. The method of claim 5, wherein each of the first voltages is used to render the FFOV image on respective pixel elements of the pixel array, and wherein at least some of the second voltages are used to render the foveal image on respective pixel elements of the pixel array.

7. The method of claim 6, wherein the scanning comprises:

activating groups of pixel elements in succession, wherein each group of pixel elements includes a plurality of rows of the pixel array; and driving the first voltages onto respective pixel elements in the plurality of rows, concurrently, for each activated group.

8. The method of claim 6, wherein the rescanning comprises:

activating each row of pixel elements in the subset of rows in succession; and driving the second voltages onto respective pixel elements in each activated row.

9. The method of claim 6, wherein the scanning is performed at a faster rate than the rescanning.

10. A display device comprising:

a pixel array including a plurality of pixel elements arranged in rows and columns;

a display driver configured to:

receive a frame of display data corresponding to an image to be displayed on the pixel array at a first instance of time;

scan each row of the pixel array, during a pixel adjustment period prior to the first instance of time, to drive a plurality of first voltages onto the plurality of pixel elements, respectively, based on the received frame; and rescan at least a subset of rows of the pixel array, during the pixel adjustment period, to drive second voltages onto respective pixel elements in the subset of rows based on the received frame;

overdrive circuitry configured to:

determine a plurality of target pixel values for the plurality of pixel elements, respectively, based on the received frame;

for each pixel element in the pixel array, determine a target voltage that causes the pixel element to settle at its target pixel value;

select at least some of the pixel elements to receive overdrive voltages based on each of the selected pixel elements having at least a threshold change in pixel value between a current pixel value and its target pixel value, wherein the overdrive voltage for a pixel element is different than the target voltage for that pixel element; and select the subset of rows to be rescanned based at least in part on the pixel elements selected to receive overdrive voltages one or more light sources configured to illuminate the pixel array at the first instance of time.

11. The display device of claim 10, wherein the one or more light sources are deactivated during the pixel adjustment period.

12. The display device of claim 10, wherein the display driver is to scan each row of the pixel array by:

driving the overdrive voltages onto respective pixel elements in the subset of rows of the pixel array; and driving the target voltages onto respective pixel elements in each of the remaining rows of the pixel array.

13. The display device of claim 10, wherein the display driver is to rescan each row of the pixel array by:

driving the target voltages onto respective pixel elements in the subset of rows of the pixel array.

14. The display device of claim 13, wherein the image includes a full field-of-view (FFOV) image and a foveal image positioned within the FFOV image, wherein the display driver is further configured to:

for each pixel of the FFOV image, select a plurality of pixel elements of the pixel array to display the pixel of the FFOV image;

for each pixel of the foveal image, select a respective pixel element of the pixel array to display the pixel of the foveal image; and select the subset of rows based at least in part on the pixel elements selected to display the foveal image.

15. The display device of claim 14, wherein each of the first voltages is used to render the FFOV image on respective pixel elements of the pixel array, and wherein at least some of the second voltages are used to render the foveal image on respective pixel elements of the pixel array.

16. The display device of claim 15, wherein the display driver is to scan each row of the pixel array by:

activating groups of pixel elements in succession, wherein each group of pixel elements includes a plurality of rows of the pixel array; and driving the first voltages onto respective pixel elements in the plurality of rows, concurrently, for each activated group.

17. The display device of claim 15, wherein the display driver is to rescan each row of the pixel array by:

activating each row of pixel elements in the subset of rows in succession; and driving the second voltages onto respective pixel elements in each activated row.

18. The display device of claim 15, wherein the scan is performed at a faster rate than the rescan.

* * * * *